US011235253B2

(12) United States Patent
Towne et al.

(10) Patent No.: US 11,235,253 B2
(45) Date of Patent: Feb. 1, 2022

(54) DOLL

(71) Applicant: Lorelei Charlotte, LLC, Dania Beach, FL (US)

(72) Inventors: Charlotte Towne, Dania Beach, FL (US); Peter Solomon, Hollywood, FL (US)

(73) Assignee: Lorelei Charlotte, LLC, Dania Beach, FL (US)

( * ) Notice: Subject to any disclaimer, the term of this patent is extended or adjusted under 35 U.S.C. 154(b) by 0 days.

(21) Appl. No.: 16/587,194

(22) Filed: Sep. 30, 2019

(65) Prior Publication Data

US 2020/0238183 A1 Jul. 30, 2020

Related U.S. Application Data

(63) Continuation-in-part of application No. 16/260,763, filed on Jan. 29, 2019, now abandoned.

(51) Int. Cl.
*A63H 3/00* (2006.01)
*A63H 3/52* (2006.01)

(52) U.S. Cl.
CPC ..... *A63H 3/005* (2013.01); *A63H 3/52* (2013.01)

(58) Field of Classification Search
CPC . A63H 3/36; A63H 3/48; A63H 3/005; A63H 3/52
USPC ..... 446/268, 320
See application file for complete search history.

(56) References Cited

U.S. PATENT DOCUMENTS

| | | | |
|---|---|---|---|
| 1,148,540 | A | 8/1915 | Sancier |
| 1,259,782 | A | 3/1918 | Savage |
| D56,667 | S | 11/1920 | Haines |
| 1,396,766 | A | 11/1921 | McClelland |
| 1,407,165 | A | 2/1922 | Pajeau |
| 1,567,661 | A | 12/1925 | Levaggi et al. |
| 1,784,369 | A | 12/1930 | Lowenbaum |
| 1,886,442 | A | 11/1932 | Wimmer |
| 1,966,986 | A | 7/1934 | Martin |

(Continued)

FOREIGN PATENT DOCUMENTS

| | | | |
|---|---|---|---|
| GB | 2303077 | A | 2/1997 |
| JP | 1020879 | A | 1/1989 |

(Continued)

OTHER PUBLICATIONS

International Search Report and Written Opinion dated May 6, 2010; corresponding to International Application No. PCT/US2009/060294 filed on Oct. 10, 2009; consisting of 6-pages.

*Primary Examiner* — Joseph B Baldori
(74) *Attorney, Agent, or Firm* — Christopher & Weisberg, P.A.

(57) ABSTRACT

The present invention is generally related to dolls, and in particular, a doll having a costume element such that the doll can change into different characters using the costume element. The doll may have body with a torso and at least one appendage. The doll also may have at least one from the group consisting of the torso and the at least one appendage that defines a cavity and a costume element that is storable within the cavity. At least a portion of the costume element is configured to engage at least a portion of the body of the doll. The costume element may be any design including a tail, wings, an outfit, pants, a shirt, a head piece, a swimsuit, a jacket, or any other type of costume.

17 Claims, 41 Drawing Sheets

(56) References Cited

U.S. PATENT DOCUMENTS 2,042,270 A * 5/1936 Moore ..... A63H 33/20 446/51
2,195,127 A 3/1940 Brucker
2,219,311 A 10/1940 Hammond et al.
2,274,303 A 2/1942 Ornstein
2,277,882 A 3/1942 Quady
2,325,750 A 8/1943 De Vries
2,380,175 A 7/1945 Hawkey
2,825,905 A 3/1958 Merl
3,153,871 A 10/1964 Semba et al.
3,377,740 A 4/1968 Bonanno et al.
3,577,670 A 5/1971 Gutierrez
3,724,125 A 4/1973 Goldfarb et al.
3,758,982 A 9/1973 Lemelson et al.
3,797,166 A 3/1974 Murray
3,851,419 A 12/1974 Kaelin
3,906,661 A 9/1975 Weiser
4,008,541 A 2/1977 Russer
4,030,239 A 6/1977 White et al.
4,107,873 A 8/1978 Bauer
4,168,592 A 9/1979 Merino
D255,476 S 6/1980 Cox
4,227,264 A 10/1980 Spector et al.
4,244,138 A 1/1981 Holahan et al.
4,279,419 A 7/1981 Barnes et al.
4,307,533 A 12/1981 Sims et al.
4,336,665 A 6/1982 Moreau
4,512,690 A 4/1985 Johnson
4,543,669 A * 10/1985 Katz ..... A41D 11/00 2/84
4,568,304 A 2/1986 Santa Maria
4,571,206 A 2/1986 Mayer et al.
4,575,349 A 3/1986 Piazza et al.
4,601,478 A 7/1986 Robertson et al.
4,610,639 A 9/1986 Piazza
4,639,233 A 1/1987 Brassfield
4,715,840 A 12/1987 Swift
4,718,877 A 1/1988 Girsch et al.
4,842,565 A * 6/1989 VonPhilp, Sr. ..... A63H 3/02 446/321
4,867,729 A 9/1989 Weinman et al.
4,921,459 A 5/1990 Cook et al.
4,995,846 A 2/1991 Mariol
5,011,445 A 4/1991 Nakasuji et al.
5,015,209 A 5/1991 Ortiz
D317,341 S 6/1991 Cardillo
5,046,986 A 9/1991 Wood et al.
5,127,107 A 7/1992 Wood et al.
5,149,289 A 9/1992 Edwards et al.
5,167,562 A 12/1992 Axtell
5,172,863 A 12/1992 Melone et al.
5,186,673 A 2/1993 Fogarty et al.
5,197,885 A * 3/1993 Friedel ..... A63H 3/003 434/236
5,201,073 A * 4/1993 Spanier ..... A41B 13/103 2/247
5,224,894 A 7/1993 Nelson et al.
5,235,997 A 8/1993 Good
5,238,437 A 8/1993 Vowles et al.
5,277,645 A 1/1994 Kelley et al.
5,310,378 A 5/1994 Shannon
5,328,400 A 7/1994 Bass
5,378,188 A 1/1995 Clark
5,503,583 A 4/1996 Hippely et al.
5,525,086 A 6/1996 Gentile et al.
5,588,895 A 12/1996 Larson
5,651,717 A 7/1997 Hamilton et al.
5,746,639 A * 5/1998 Bloom ..... A63H 3/02 446/369
5,803,787 A 9/1998 Kulchyski
5,842,905 A 12/1998 Lee et al.
5,868,598 A 2/1999 Dinovo
D415,221 S 10/1999 Dial
5,964,638 A 10/1999 Emerson
D417,707 S 12/1999 Gilford
6,012,962 A 1/2000 Arriola
6,086,446 A 7/2000 Arriola
6,132,285 A 10/2000 Feldman
6,152,799 A 11/2000 Arriola
6,200,190 B1 3/2001 Reynolds
6,224,456 B1 5/2001 Wittenberg
6,280,281 B1 8/2001 Unalp
6,280,283 B1 * 8/2001 Sisler ..... A63H 3/365 446/100
6,322,421 B1 11/2001 Hou
6,425,796 B1 7/2002 Gaynor et al.
6,450,855 B1 9/2002 Tang
6,508,688 B1 1/2003 Liu
6,557,175 B2 5/2003 Greenblatt
6,736,692 B1 5/2004 Hoyos-Zermeno et al.
6,755,712 B2 * 6/2004 Morris ..... A63H 3/005 446/268
6,857,930 B1 2/2005 Lawley, Jr.
6,902,462 B2 * 6/2005 Treibitz ..... A63H 3/005 446/369
6,962,517 B2 11/2005 Murray
6,962,518 B2 11/2005 Wang
7,175,496 B1 2/2007 Lund et al.
D548,962 S 8/2007 Meyers
7,575,496 B2 8/2009 Lau et al.
7,662,016 B2 2/2010 Okamoto et al.
7,727,043 B2 6/2010 Whitaker
8,087,971 B2 1/2012 Asai
8,128,450 B2 3/2012 Imai
8,133,090 B2 3/2012 Hardin
8,152,587 B1 * 4/2012 Brown ..... A63H 3/02 206/216
8,333,634 B2 12/2012 Norman et al.
8,337,271 B2 12/2012 Campbell et al.
8,376,805 B2 2/2013 Komorous-Towey et al.
8,393,932 B1 3/2013 Norman et al.
8,506,344 B2 8/2013 Chan et al.
8,684,782 B2 4/2014 Fiore
8,777,688 B2 7/2014 Barthold
8,944,877 B2 2/2015 Higuchi
9,162,110 B1 10/2015 Browning et al.
9,168,462 B2 10/2015 Jung
9,604,103 B2 3/2017 Browning et al.
9,861,858 B2 1/2018 Browning et al.
2002/0022431 A1 * 2/2002 Schneider ..... A63H 3/005 446/73
2003/0087580 A1 5/2003 Shibahashi et al.
2005/0164598 A1 7/2005 Kelsey
2005/0191936 A1 9/2005 Marine et al.
2006/0111013 A1 5/2006 Lau et al.
2006/0148377 A1 7/2006 Stubenfoll
2006/0234599 A1 10/2006 Mo et al.
2006/0281387 A1 12/2006 Mcmahan et al.
2006/0292965 A1 12/2006 Strauss
2007/0155280 A1 7/2007 Patean et al.
2007/0232186 A1 * 10/2007 Shamah ..... A63H 3/02 446/369
2008/0207079 A1 8/2008 Corsiglia et al.
2008/0233833 A1 9/2008 Toriyama et al.
2009/0075555 A1 3/2009 Barthold
2009/0191783 A1 * 7/2009 Spitzer ..... A63H 3/00 446/73
2009/0253347 A1 10/2009 Byrd
2009/0264045 A1 10/2009 Hardin
2010/0093254 A1 4/2010 Jung
2010/0167624 A1 7/2010 Asai
2010/0330871 A1 12/2010 Okumura et al.
2011/0076915 A1 3/2011 Campbell et al.
2011/0111669 A1 5/2011 Chan et al.
2011/0250818 A1 10/2011 Geurts
2012/0045960 A1 2/2012 Kane et al.
2012/0052764 A1 3/2012 Chan
2012/0071060 A1 3/2012 Cannon
2012/0088428 A1 * 4/2012 Smoot ..... A63H 3/02 446/73
2012/0142249 A1 6/2012 Chan et al.
2013/0288564 A1 10/2013 Chan et al.

(56) References Cited

U.S. PATENT DOCUMENTS

| | | | | |
|---|---|---|---|---|
| 2014/0329435 | A1 | 11/2014 | Chan et al. | |
| 2015/0072589 | A1* | 3/2015 | Chan | A63H 33/22 446/219 |
| 2015/0079874 | A1 | 3/2015 | Strauss | |
| 2016/0051860 | A1 | 2/2016 | Browning et al. | |
| 2017/0189759 | A1 | 7/2017 | Browning et al. | |

FOREIGN PATENT DOCUMENTS

| | | | |
|---|---|---|---|
| JP | 3-3389 | U | 1/1991 |
| JP | 9187575 | A | 7/1997 |
| JP | 11207047 | A | 8/1999 |
| JP | 11333149 | A | 12/1999 |
| WO | 9305857 | A1 | 4/1993 |
| WO | 2007/010264 | A3 | 1/2007 |

* cited by examiner

DOLL

CROSS-REFERENCE TO RELATED APPLICATION

This application is a continuation-in-part of U.S. application Ser. No. 16/260,763, filed Jan. 29, 2019.

STATEMENT REGARDING FEDERALLY SPONSORED RESEARCH OR DEVELOPMENT n/a

FIELD OF THE INVENTION

The present invention is generally related to dolls, and in particular, a doll having a costume element such that the doll can change into different characters using the costume element.

BACKGROUND OF THE INVENTION

Dolls have long been a part of children's toys and have been around for centuries. Dolls offer many opportunities to develop cognitive, fine motor, self-help skills, as well as the imagination. Children can use dolls to apply skills to the doll before they can apply the skillset to themselves.

Playing with dolls is important in developing social skills. For example, when playing house with a doll, the child learns to communicate with one another kindly and cooperatively while also learning how to care for one another. When a child uses dolls to mimic real life situations, it helps in learning how to deal with and manage a variety of different issues.

Responsibility is also developed through dolls. Children can learn how to take care of a doll by playing with it which can translate into day-to-day responsibilities. This type of play can help the child learn to care for their pets and also more readily understand how to care and help siblings, friends, and relatives.

Processing and understanding of emotions also occurs when playing with dolls. Entering a world of make believe with a doll can help a child understand what is going on in the world around them and help with the development of empathy and compassion for others. This type of dramatic play also helps develop the imagination with creative and imagined scenarios.

Doll playing with others creates unique situations where children communicate with one another and strengthen their vocabulary. This type of communication allows a child to gain insight into routines and is a way for the child to discover the world around them.

Dolls also help with the development of gross and fine motor skills as children use their muscles in new and different ways. For example, gross motor skills develop when lifting the doll, walking with the doll, and pushing the doll in a stroller as these movements involve large muscles of the arms, legs, and torso. Additionally, fine motor skills are developed when changing the doll, putting costumes and other decorative pieces on the doll, feeding the doll, as well as doing other self-care skills like grooming.

However, there is no easy way to transition a doll into different costume elements. For example, an individual using a doll would have to purchase numerous dolls and/or separate pieces for the doll if they wanted, a "human doll," a "mermaid doll," a "fairy doll," a "mouse doll," a "superhero doll," a "cat doll", a "unicorn doll", an "angel doll" and "princess/queen doll," and there is no easy way to transform a doll using different costume elements that are removable into different characters.

SUMMARY

The present invention advantageously provides a doll. The doll includes a costume element such that the doll can change using at least one costume element. The doll may comprise a body having a torso and at least one appendage. At least one from the group consisting of the torso and the at least one appendage may define a cavity. A costume element may be storable within the cavity and at least a portion of the costume element may be configured to engage at least a portion of the body.

In one aspect of the embodiment, the cavity may be translucent.

In one aspect of the embodiment, the doll may further comprise a deployment mechanism disposed within the cavity. The costume element may be retained by the deployment mechanism.

In one aspect of the embodiment, the cavity may include a door enclosing the cavity.

In one aspect of the embodiment, the door may be releasably affixed to the cavity.

In one aspect of the embodiment, the body may define a cavity and the costume element may be wrapped around a spring loaded roller within the body. The costume element may be configured to wrap around at least a portion of the body.

In one aspect of the embodiment, the exterior surface of the body may be configured to releasably affix to the costume element with a retaining mechanism.

In one aspect of the embodiment, the costume element may include a tail and a fluke.

In one aspect of the embodiment, at least a portion of the fluke may be rigid.

In another embodiment, the doll may comprise a torso, at least one appendage connected to the torso, and a rod. The rod may be disposed within the torso and may be connecting the at least one appendage to the torso. The rod may be moveable between at least a first position where the torso and the appendage are proximate to each other and a second position where the torso and the appendage are a spaced distance away from each other. The torso may define at least one cavity and the cavity may be sized to receive a costume element. The costume element may be deployable when the rod is moved from the first position to the second position.

In one aspect of the embodiment, the costume element may be concealed in the first position.

In one aspect of the embodiment, the costume element is deployable in the second position.

In one aspect of the embodiment, the costume element may have a tail and a fluke.

In one aspect of the embodiment, at least a portion of the fluke may be secured to at least one appendage.

In one aspect of the embodiment, the fluke may be disposed in the first position where the fluke is disengaged from the at least one appendage and the second position where the fluke is secured to the at least one appendage.

In one aspect of the embodiment, the fluke and the tail are disposed within the cavity in the torso.

In one aspect of the embodiment, the fluke is releasably secured to the rod.

In one aspect of the embodiment, the fluke is releasably securable to the at least one appendage and the fluke is movable from the rod to the at least one appendage.

In one aspect of the embodiment, the rod may have a proximal end and a distal end. The distal end of the rod may have a nub which is releasably securable within a cavity within the first position and the second position.

In another embodiment, the transformable doll may comprise a head, a costume element having a tail and a fluke and a body portion. The body portion may have a torso and at least one appendage, the appendage may have at least one retaining mechanism and at least one from the group consisting of the torso and the at least one appendage defining a cavity therein configured to retain a costume element. The costume element may be configured to engage with the torso and the at least one appendage and the costume element being releasably securable to the at least one appendage.

The details of one or more aspects of the disclosure are set forth in the accompanying drawings and the description below. Other features, objects, and advantages of the techniques described in this disclosure will be apparent from the description and drawings, and from the claims.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

The system and methods disclosed herein are for a doll that may transform from one character into another character. Specifically, described herein are dolls that have a costume element to transform the doll from one character to another character. While the figures show the doll transforming from a human to a mermaid, this is a non-limiting example as the costume element can be used to transform the doll into different characters using different costume elements.

Before describing in detail exemplary embodiments that are in accordance with the disclosure, it is noted that components have been represented, where appropriate, by conventional symbols in drawings, showing only those specific details that are pertinent to understanding the embodiments of the disclosure so as not to obscure the disclosure with details that will be readily apparent to those of ordinary skill in the art having the benefit of the description herein.

As used herein, relational terms, such as "first," "second," "top" and "bottom," and the like, may be used solely to distinguish one entity or element from another entity or element without necessarily requiring or implying any physical or logical relationship or order between such entities or elements. The terminology used herein is for the purpose of describing particular embodiments only and is not intended to be limiting of the concepts described herein. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

It should be understood that various aspects disclosed herein may be combined in different combinations than the combinations specifically presented in the description and accompanying drawings. It should also be understood that, depending on the example, certain processes or methods described herein may be performed in a different sequence, may be added, merged, or left out altogether (e.g., all described acts or events may not be necessary to transform the doll).

Figure 1:
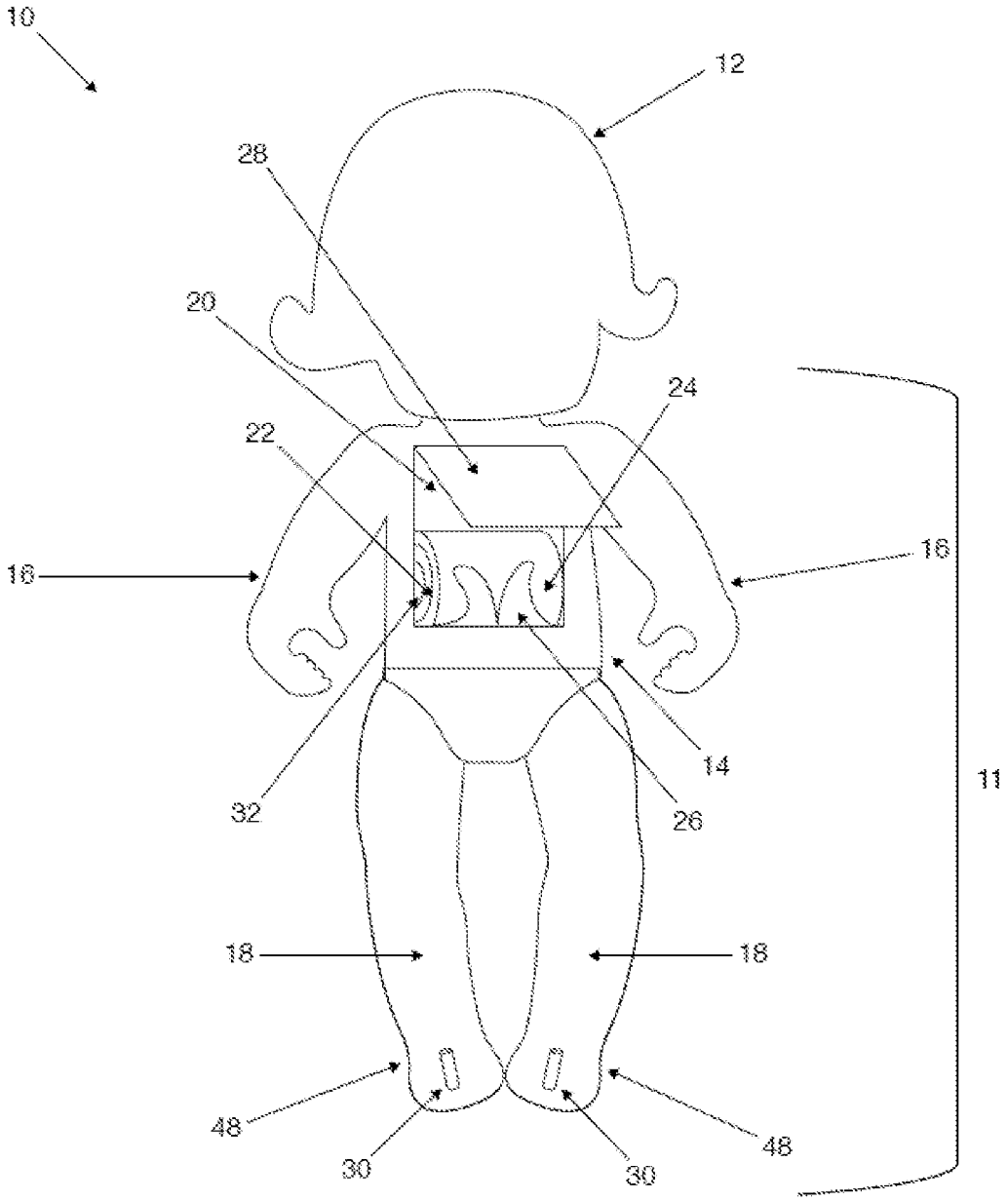
FIG. 1 is an overhead view of an exemplary embodiment of a doll constructed in accordance with the present invention.

Now referring to the drawings in which like reference designators refer to like elements, there is shown in FIG. 1 a doll constructed in accordance with the principles of the present invention and designated generally as "10." In one configuration, the doll 10 includes a body 11, which may include a head 12, a torso 14, and at least one appendage, which may include, for example, at least one arm 16 and at least one leg 18, and in one configuration, includes two arms 16 and two legs 18. As used herein, the term "appendage" refers to anything which projects and/or extends from the body 11. At least a portion of the body 11 may define a cavity 20 therein configured to retain a costume element 22. In one configuration, as shown in FIG. 1, the torso 14 defines the cavity 20. In other configurations, the head 12 or at least one appendage may define one or more cavities 20. As a non-limiting example, the head 12 may define a cavity 20 configured to retain a costume element 22 and/or at least one leg 18 may define a cavity 20 configured to retain a costume element 22. The costume element 22 may be entirely concealed within the cavity 20 or it may be at least partially concealed within the cavity 20. The cavity 20 may be disposed anywhere within any appendage. In one embodiment, the costume element 22 includes a mermaid tail 24 and a mermaid fluke 26, or alternatively, the costume element 22 may be a tail, wings, an outfit, pants, a shirt, a head piece, a swimsuit, a jacket, a backpack, a hat, a cap, a halo, a tiara, ears, a mask, or any other type of costume. In one configuration, the cavity 20 is exposed such that it is directly accessible from an exterior. In another configuration, the cavity 20 may be enclosed or covered with a structure such as a door 28, which may be permanently or releasably affixed to the portion of the body 11 defining the cavity 20. Alternatively, the cavity 20 may be enclosed with a zipper and the zipper may be used to open and close the cavity 20.

The costume element 22 may be retained within the cavity 20 with a retaining and/or deployment mechanism 30. When the costume element 22 is within the cavity 20, a portion of the costume element 22 may be visible outside of the cavity 20. For example, if the costume element 22 is composed of a tail 24 and a fluke 26, the tail 24 may be concealed within the cavity 20 and at least a portion of the fluke 26 may be visible to create wings or another structure. The retaining and/or deployment mechanism 30 may be a spool 32, which is sized and configured to be disposed within the cavity 20. For example, the costume element 22 may be secured to the spool 32 by wrapping the costume element 22 around the spool 32 as shown in FIG. 1. The spool 32 may be a spring loaded spool or another type of retaining and/or deployment mechanism 30 used to wind and unwind the costume element 22. Alternatively, any other type of retaining and/or deployment mechanism 30 for the costume element 22 may be used to releasably secure the costume element 22 within the cavity 20 such as a hook, a clip, or an adhesive. The doll 10 may further include additional retaining and/or deployment mechanisms 30 which may be disposed on any portion of the doll 10.

Figure 2:
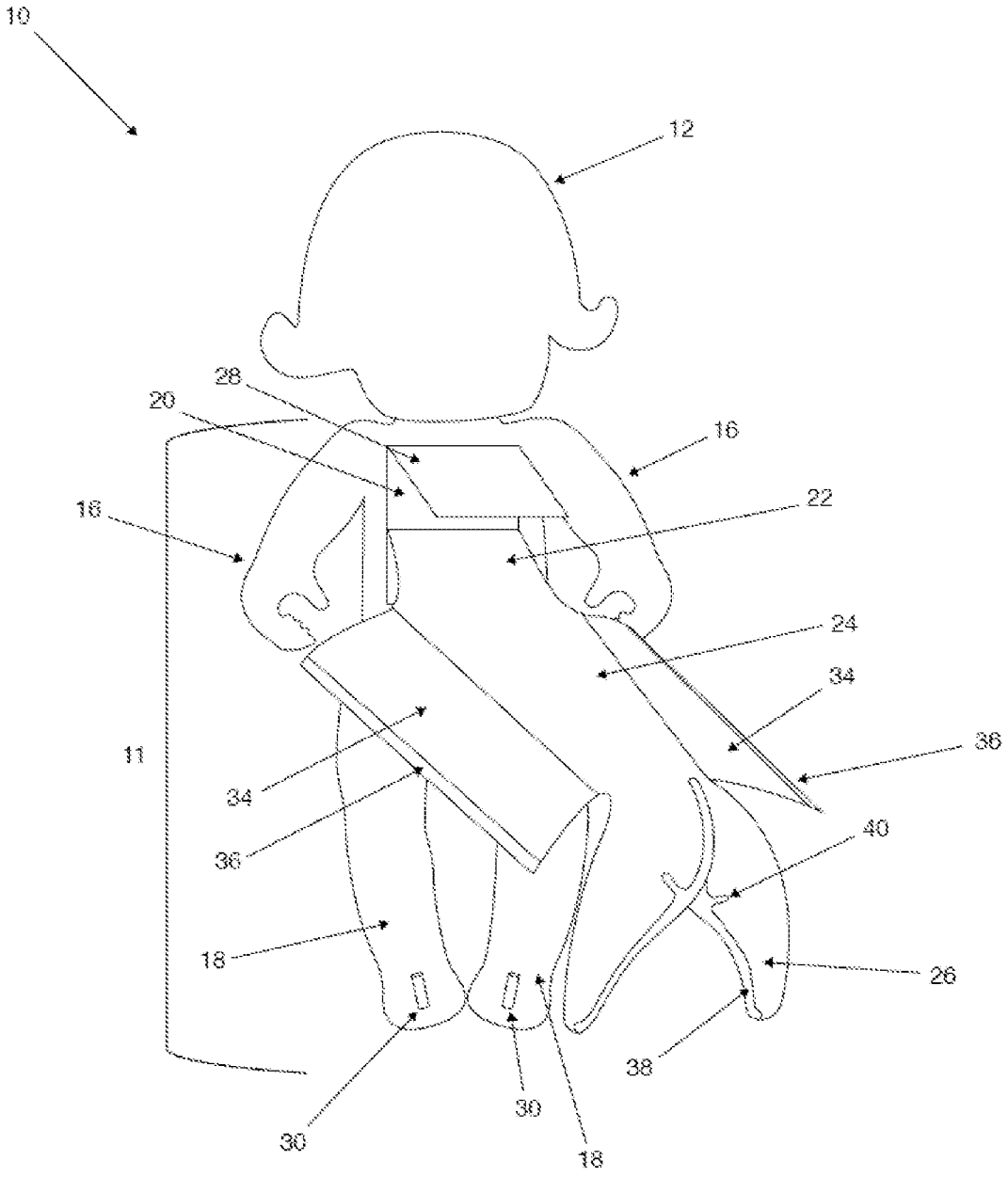
FIG. 2 is a view of the doll of FIG. 1 with the costume element being deployed from the cavity.

Referring to FIG. 2, the costume element 22 may be deployed from the cavity 20 and configured to engage with at least a portion of the body 11. In an exemplary embodiment, the costume element 22 may be deployed when a pulling force is applied to the costume element 22 and the costume element 22 unwinds from the spool 32. When the costume element 22 is unwound from the spool 32, at least a portion of the costume element 22 may be secured to the spool 32 or it may be completely separable from the spool 32. As shown in FIG. 2, when the costume element 22 is unwound, a portion of the costume element 22 may remain secured to the spool 32.

Once the costume element 22 is deployed, it may be secured to at least a portion of the body 11 of the doll 10. As shown in FIG. 2, the costume element 22 may have the tail 24 with a flap 34 secured to a portion of the tail 24 and, in one example, the retaining and/or deployment mechanism 30 may include a fastener 36 secured to the flap 34. As an example, to secure the costume element 22 to the appendage on the doll 10, the flap 34 may be secured around at least a portion of the appendage. More specifically, the flap 34 may be secured around at least one leg 18 and then the fastener 36 may be further secured around the appendage of the doll 10. In one embodiment, the fastener 36 may be a hook and loop fastener and the flap 34 may be secured in place with the hook and loop fastener. For example, the flap 34 may be wrapped around the legs 18 of the doll 10 and the fastener 36 may be further wrapped around the legs and secured in place. Also, the fastener 36 may be a zipper, buttons, and/or snap fasters.

Figure 3:
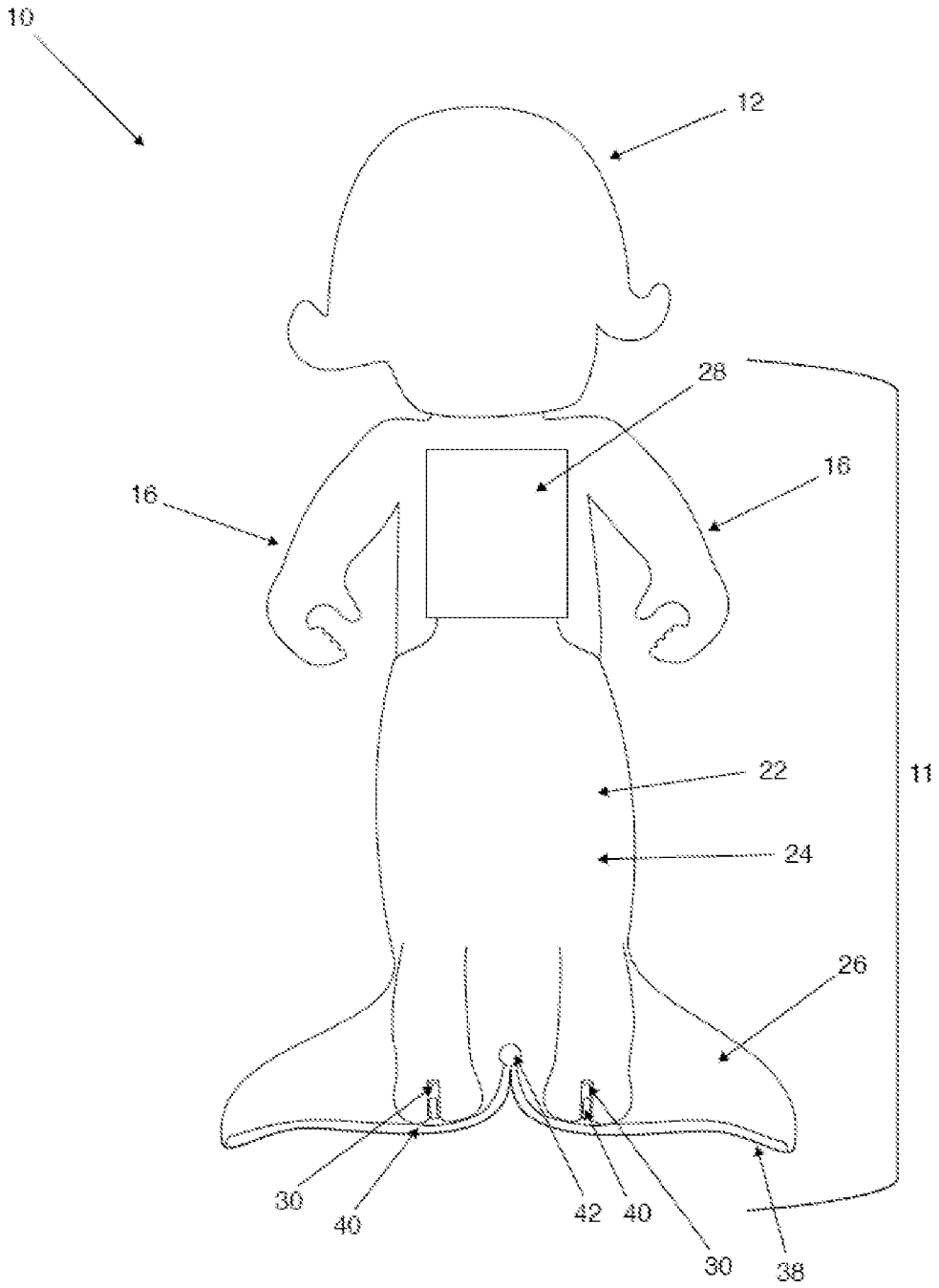
FIG. 3 is a view of the doll of FIG. 1 with the costume element being secured to a portion of the body of the doll.

The fluke 26 may have a spine 38 which may be rigid, semi-rigid, or flexible and this may allow for more realistic movement of the fluke 26 when it is secured to the doll 10. The fluke 26 may also have at least one pin 40 sized to be received within the retaining and/or deployment mechanism 30. As shown in FIG. 3, a portion of the fluke 26 may be secured to at least one appendage with the pin 40 being placed within the retaining and/or deployment mechanism 30. In one configuration, the retaining and/or deployment mechanism 30 may include an aperture sized to releasably receive the pin 40, a magnet, a hook and loop fastener, or an adhesive. The fluke 26 may also have a hinge 42 to allow for folding of the fluke 26 and which enables the fluke 26 to move once it is secured to a portion of the doll 10. Once the fluke 26 is secured to a portion of the doll 10, the spine 38 and the hinge 42 may make movement of the fluke 26 more realistic while also providing tension to hold the costume element 22 in place on the doll 10. As an example, the fluke 26 may have more than one pin 40 which are sized to be received with the retaining and/or deployment mechanism 30 that is anywhere on the doll 10 and the placement of the pin 40 and the at least one retaining and/or deployment mechanism 30 can determine the movement and flow of the costume element 22 once it is secured to the body 11.

Figure 4:
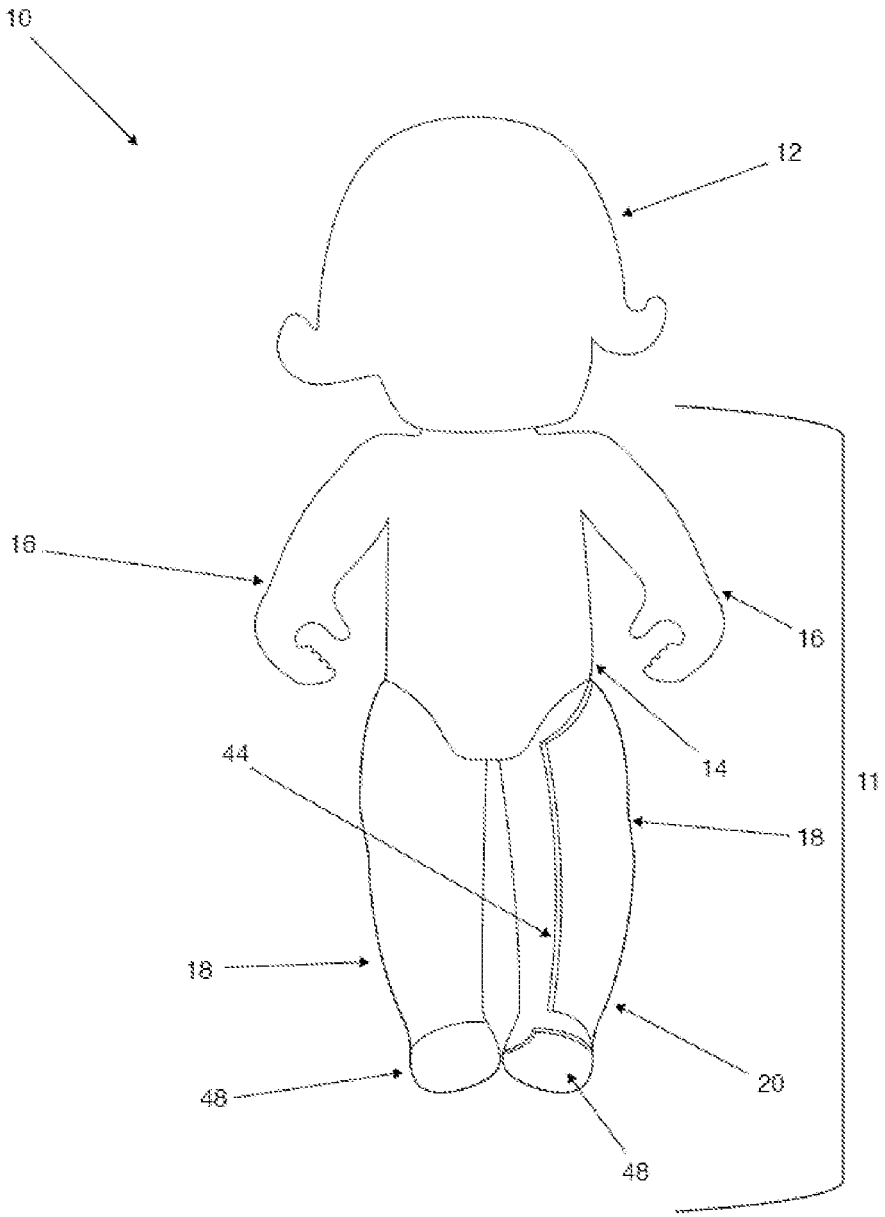
FIG. 4 is an overhead view of an exemplary embodiment of the doll with the costume element secured to the legs of the doll.
Figure 5:
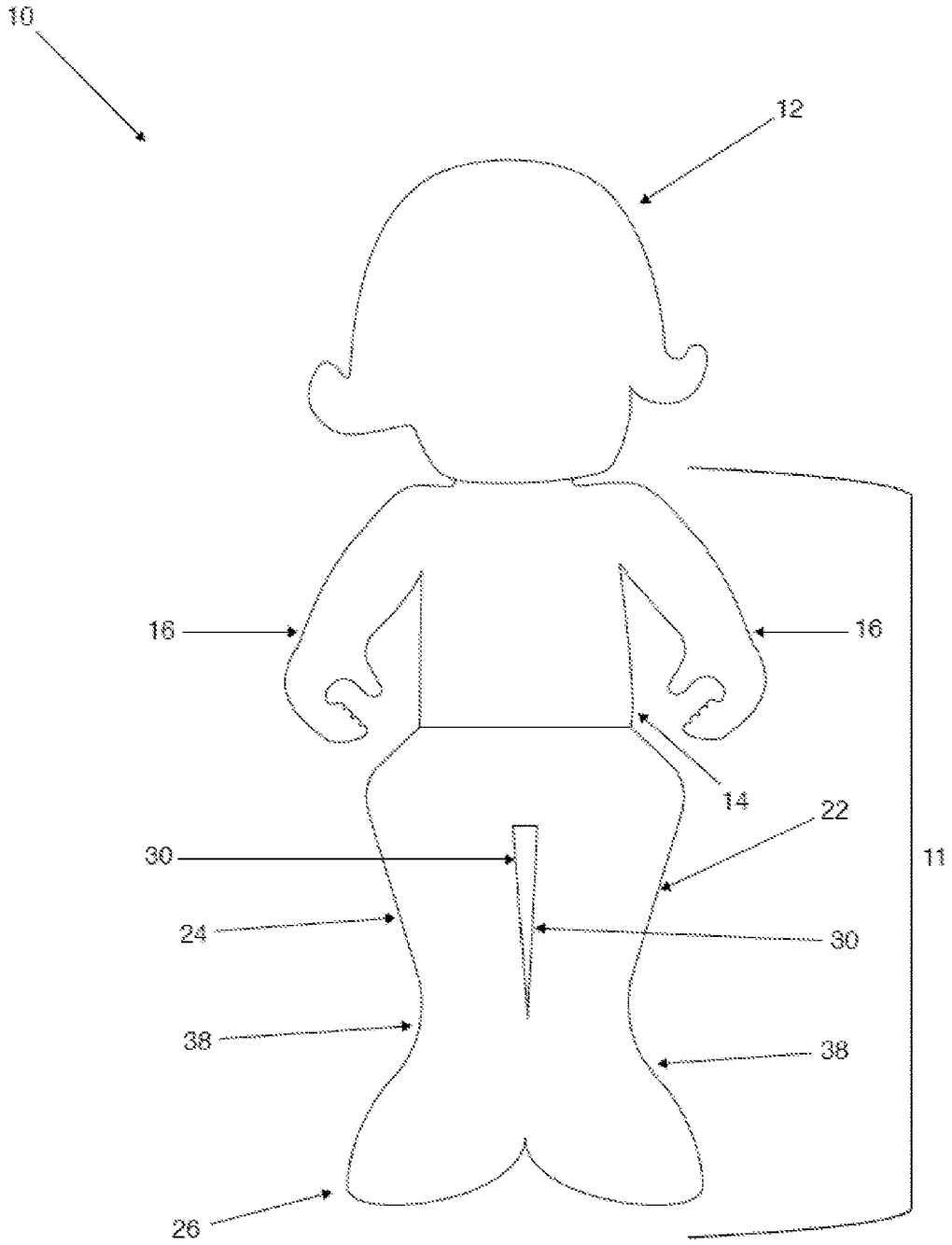
FIG. 5 is an overhead view of the doll of FIG. 4 with the costume element secured to the legs and the torso of the doll.
Figure 6:
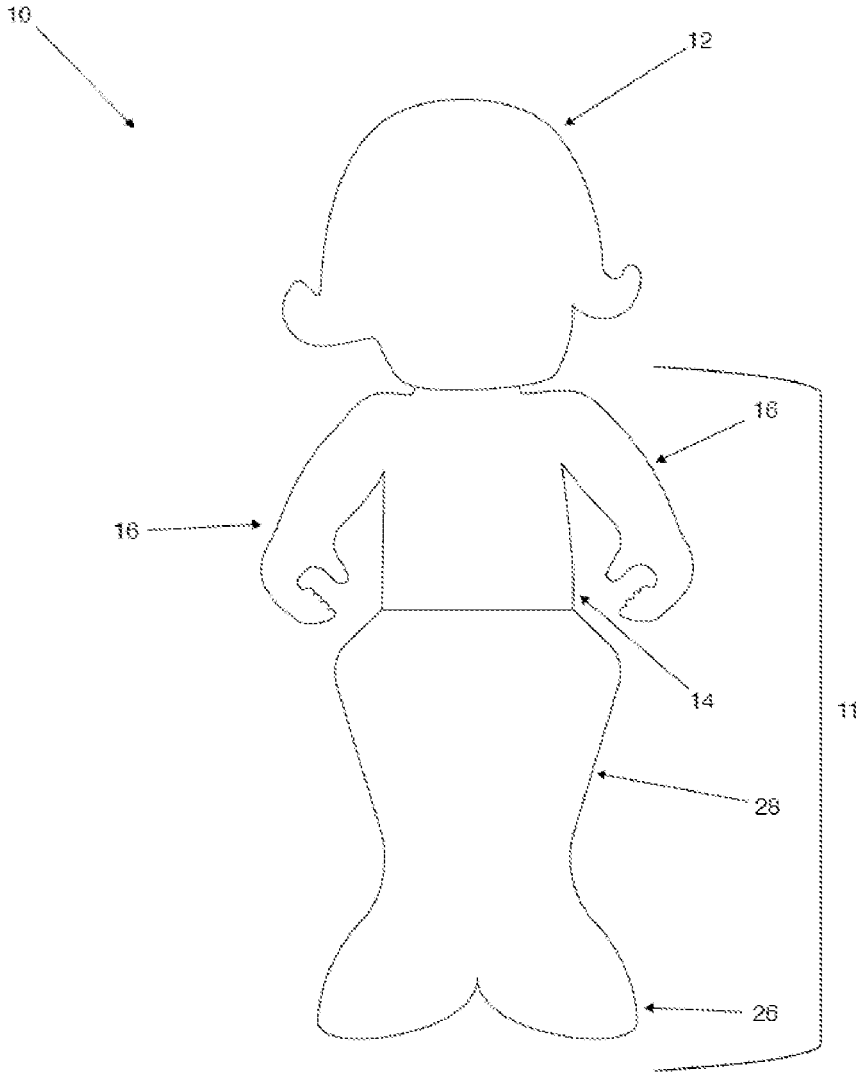
FIG. 6 is an overhead view of the doll of FIG. 4 with the costume element secured to the legs and the torso of the doll.

Referring now to FIGS. 4-6, in this embodiment, at least one appendage may define a cavity 20. This cavity 20 may be disposed on one, two, three, four, or more appendages. The costume element 22 may be releasably securable within the cavity 20. On at least a portion of the cavity 20, there may be a seam 44 which is accessible and allows the costume element 22 to be deployed from the cavity 20. For example, the doll 10 may have a retaining and/or deployment mechanism 30 such as a lever or button to deploy the costume element 22 from inside the cavity 20 to the exterior of the doll 10. The exterior of the doll 10 includes any portion of the doll 10 which is not inside the cavity 20. Alternatively, the seam 44 may be removed from the cavity 20 which allows for the costume element 22 to be deployed from inside the cavity 20. In an alternative embodiment, the legs 18 may be composed from a material that is formable into at least one position. For example, a portion of the appendage may be moved from a first position which is in the shape of a leg 18 to a second position which transforms the shape of the leg 18 into a tail 24. The material may be secured in place using some type of securing mechanism or fastener or the material may remain in place without a fastener or a securing mechanism depending upon the rigidity of the material when it is in at least one position. For example, a portion of the material may have a hook and loop fastener to secure the material into at least one position or the material may be movable from one position to a second position and remain in each position. The appendage may also be movable into a variety of different shapes and positions depending upon what is being formed with the movement into the different positions.

The costume element 22 may be deployed from the cavity 20 within the appendage and secured to the appendage using a retaining and/or deployment mechanism 30. For example, when the costume element 22 is deployed, the retaining and/or deployment mechanism 30, such as a rib and socket mechanism, may be used to retain at least a portion of the costume element 22 to the body 11 of the doll 10. The costume element 22 may be secured to at least one appendage and/or may be disposed around each appendage by wrapping the costume element 22 around the appendage and then securing it using the retaining and/or deployment mechanism 30. For example, the costume element 22 may be configured to wrap around at least a portion of the body 11 or it may be configured to wrap around the entire body 11.

The costume element 22 may also be deployable from more than one portion of the appendage. As shown in FIGS. 4-5, at least a portion of the costume element 22 may be deployed from at least one foot 48, for example two feet 48, and at least a portion of the costume element 22 may be deployed from another portion of the leg 18. The at least one foot 48 may also be moved downward to form the fluke 26. As a non-limiting example, the at least one foot 48 may be made out of material that forms the shape of the at least one foot 48 in the first position and may be movable to a second position to create the fluke 26. The retaining and/or deployment mechanism 30 may be disposed within the cavity 20 or outside the cavity 20 and then deployed automatically or by hand.

Figure 7:
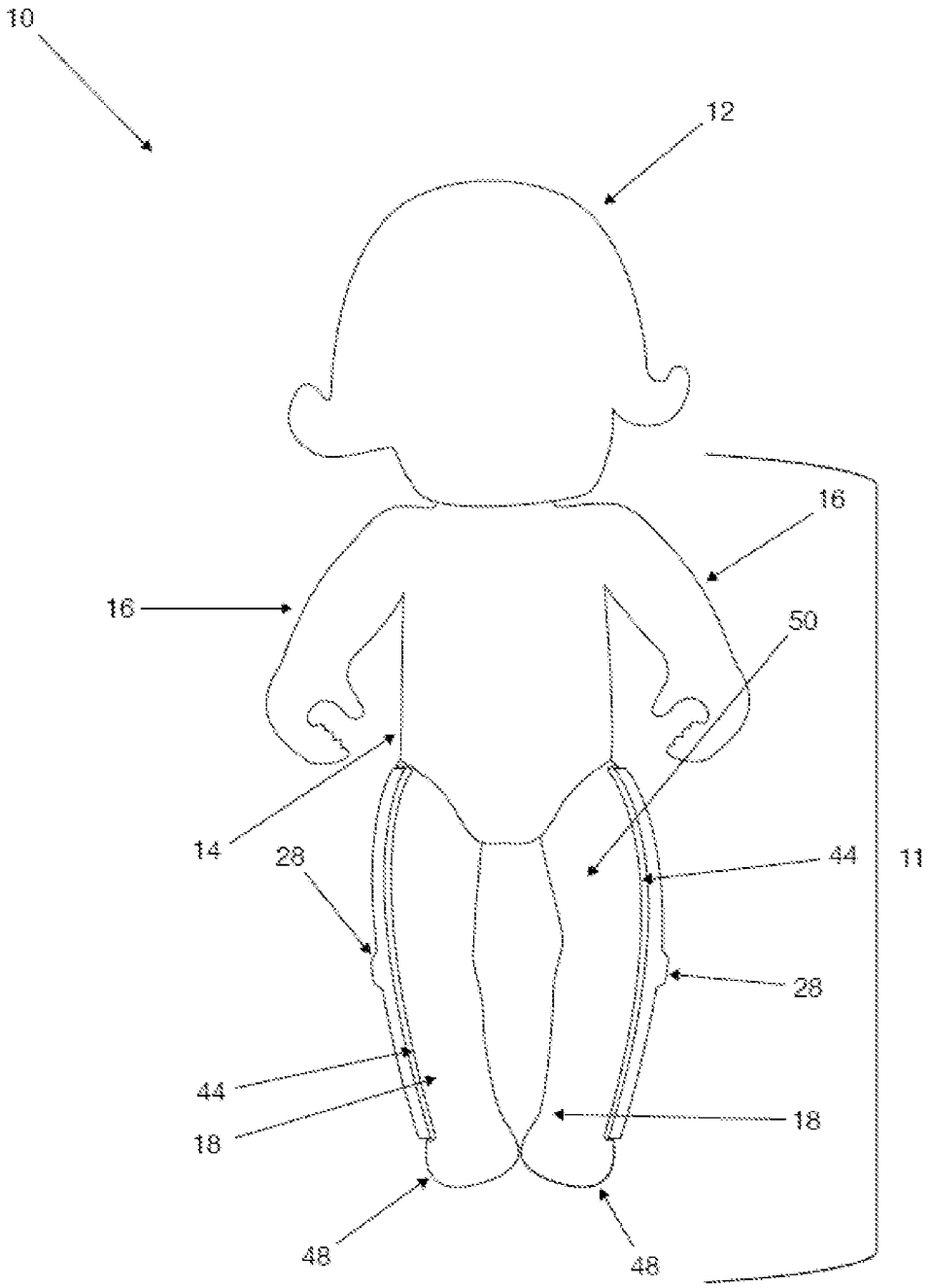
FIG. 7 is an overhead view of an exemplary embodiment of the doll with a cavity on both legs of the doll.
Figure 8:
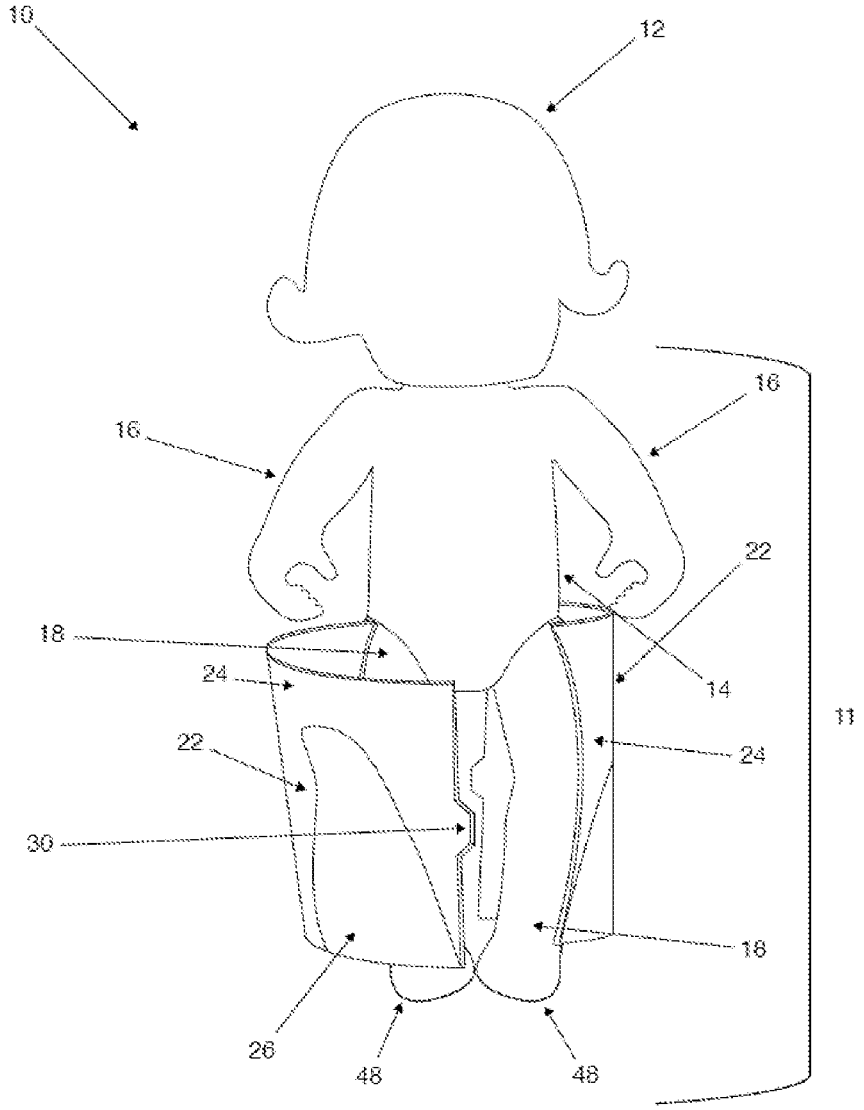
FIG. 8 is an overhead view of the doll of FIG. 7 deploying the costume element.
Figure 9:
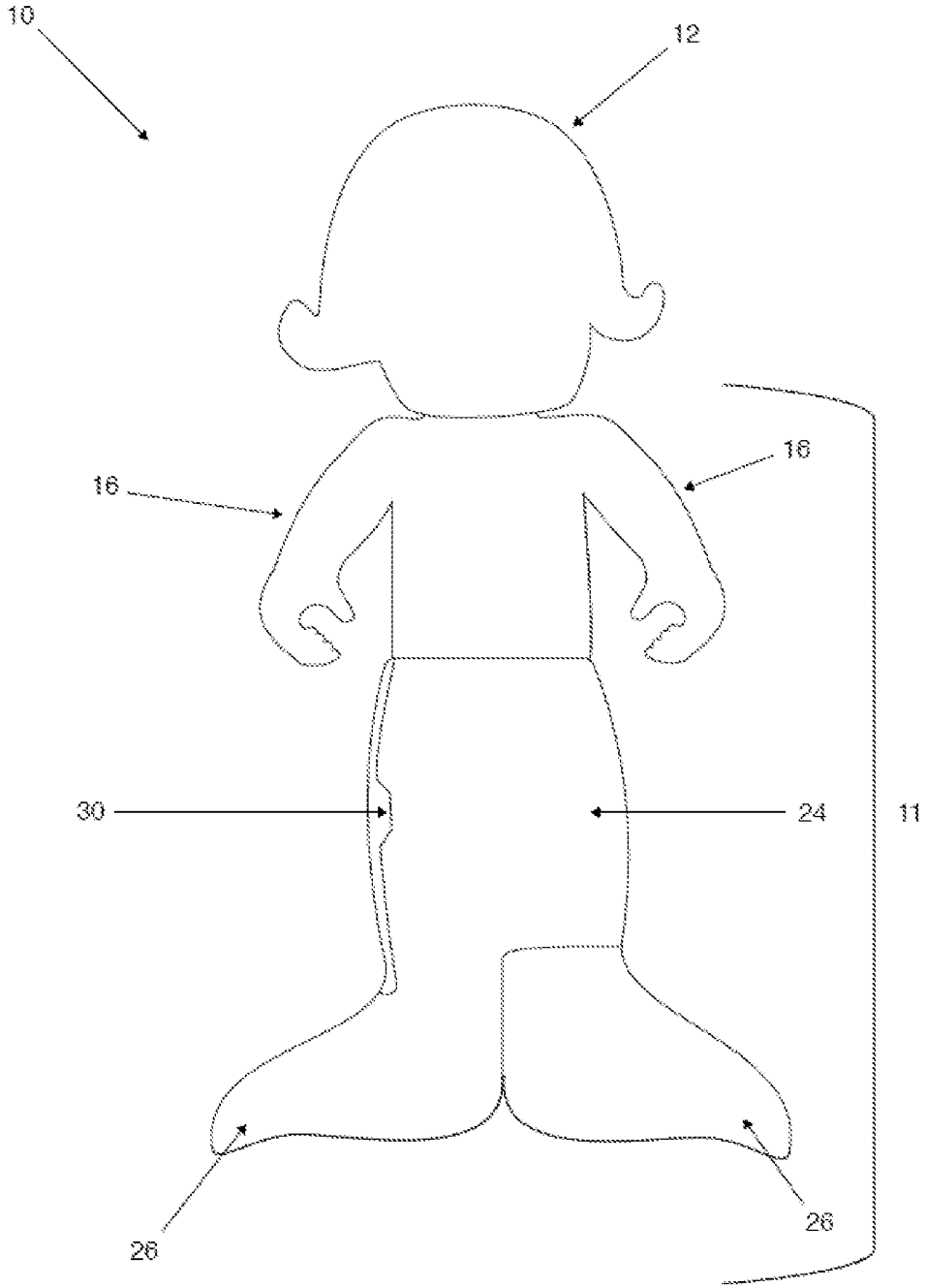
FIG. 9 is an overhead view of the doll of FIG. 7 with the costume element secured to the legs and the torso of the doll.

As shown in FIGS. 7-9, the doll 10 may also have a roller 50, for example a spring loaded roller, in the at least one appendage. The roller 50 may be disposed and concealed within the cavity 20 in at least one appendage. The door 28 or another cover may conceal the costume element 22 and releasably secure the costume element 22 inside the cavity 20. The costume element 22 may be secured, releasably secured, or entirely separable for the roller 50. In one example, the roller 50 may be disposed within the cavity 20 of each leg 18 of the doll 10. The costume element 22 may be deployed from each roller 50 by unwinding the costume element 22 and then wrapping the costume element 22 around the legs 18 of the doll 10. In one embodiment, the costume element 22 that is deployed from one leg 18 of the doll 10 may be secured around a first portion of the doll 10 and the costume element 22 that is deployed from the other leg 18 of the doll 10 may be secured around a second portion of the doll 10 using a retaining and/or deployment mechanism 30 such as a hook and loop fastener, a tab, or other retaining and/or deployment mechanism 30.

Now referring to FIGS. 8-9, the costume element 22, which includes the tail 24 and the fluke 26, may be disposed in at least one cavity 20 in the appendage. A lever, button, or other retaining and/or deployment mechanism 30 may be used to deploy both the tail 24 and/or the fluke 26 either separately or together from the cavity 20 or it may be removed manually. Alternatively, the at least one cavity 20 in the appendage may retain the tail 24 and the appendage may have an opening 52 disposed on at least a portion of the appendage where the fluke 26 may be deployed from. Once the fluke 26 is deployed, it may fold down and cover the foot 48 to create a mermaid tail. At least a portion of the doll 10 may change color when exposed to water and/or temperature changes. For example, the legs 18 may be flesh colored and when they are exposed to water they may turn into one color or more than one color.

Figure 10:
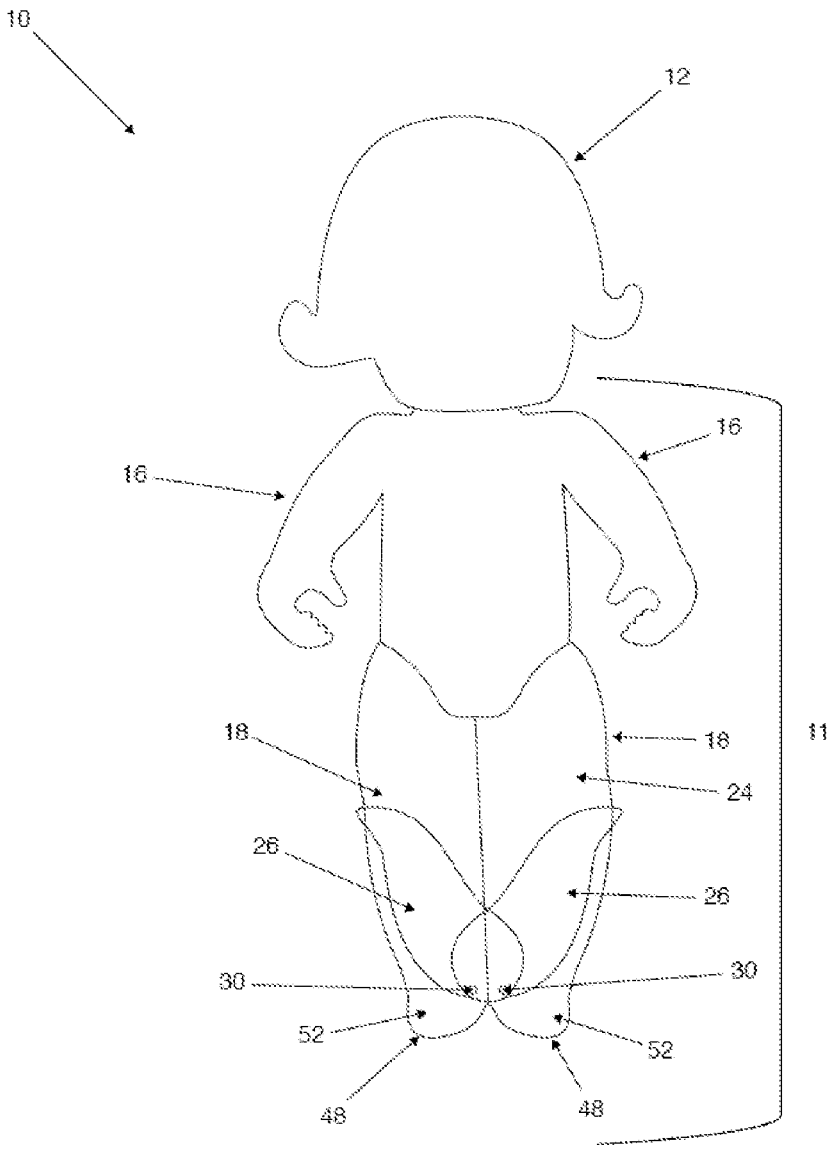
FIG. 10 is an overhead view of an exemplary embodiment of the doll with the fluke disposed within the legs.
Figure 11:
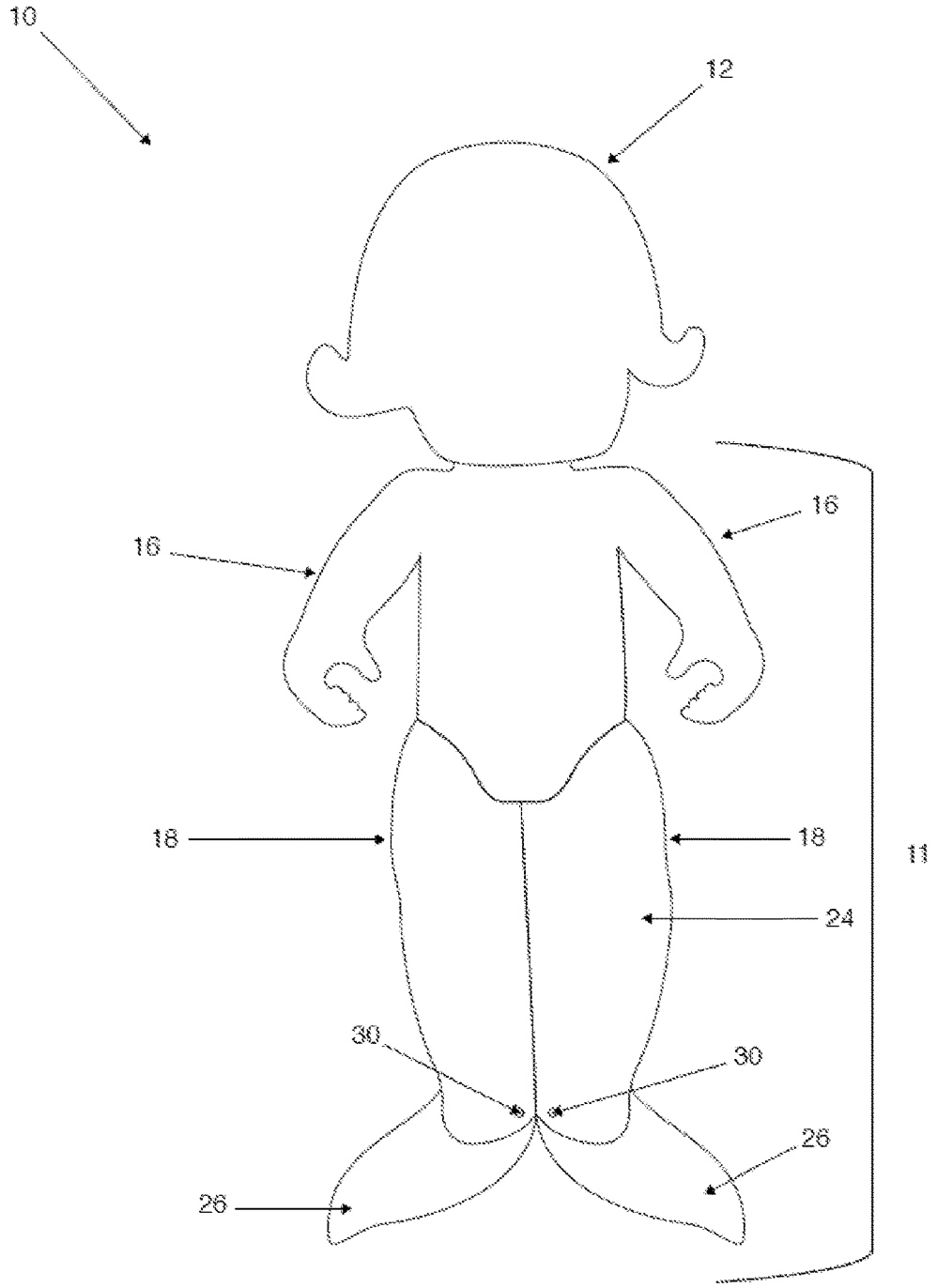
FIG. 11 is an overhead view of the doll of FIG. 10 with the costume element on the legs and feet of the doll.
Figure 12:
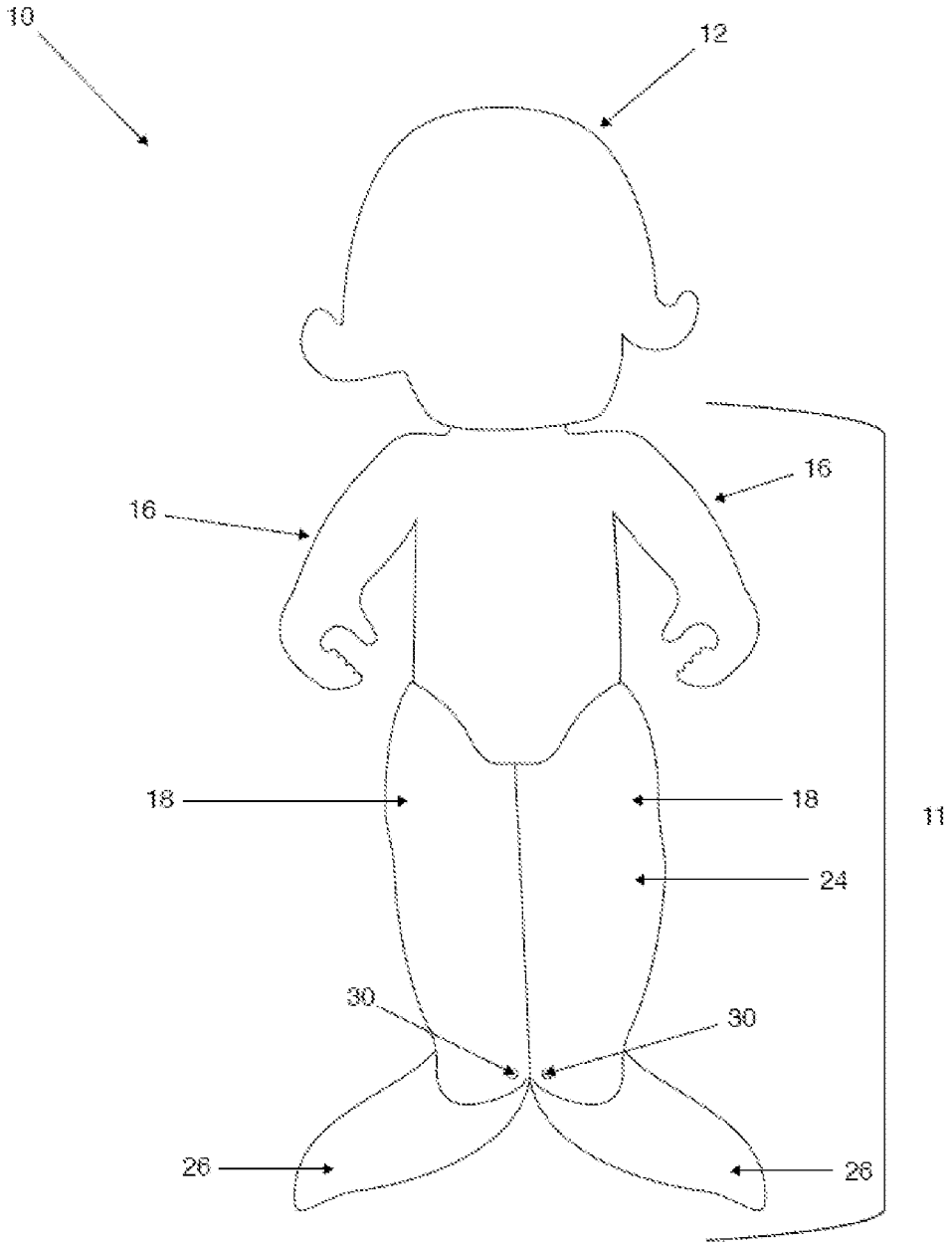
FIG. 12 is an overhead view of the doll of FIG. 10 with the costume element on the legs and feet of the doll.

Referring now to FIGS. 10-12, the legs 18 may be permanently coupled, separable from each other, and/or one leg 18 may be movable with respect to the other leg 18. The legs 18 may have a portion of the costume element 22 in the cavity 20. In one configuration, when the costume element 22 is inside the cavity 20 the feet 48 of the doll 10 may have shoes or another covering. The fluke 26 may be releasably disposed within the cavity 20, and there may be a retaining and/or deployment mechanism 30, such as a knob, lever, button or other mechanism to deploy the fluke 26 from inside the cavity 20. The feet 48 may have an opening 52 or a door 28 to allow the fluke 26 to be deployed from the cavity 20 to the base of the foot 48. The fluke 26 may retained to a portion of an appendage using a screw of other retaining and/or deployment mechanism 30 such that the fluke 26 may be movable in all directions to create realistic and lifelike movement. Alternatively, the fluke 26 may be disposed on one side of the legs 18 may be movable into different positions. Any portion of the doll 10 may be treated with a paint or finish where the color may change when exposed, for example, to water or to a change in temperature.

Figure 13:
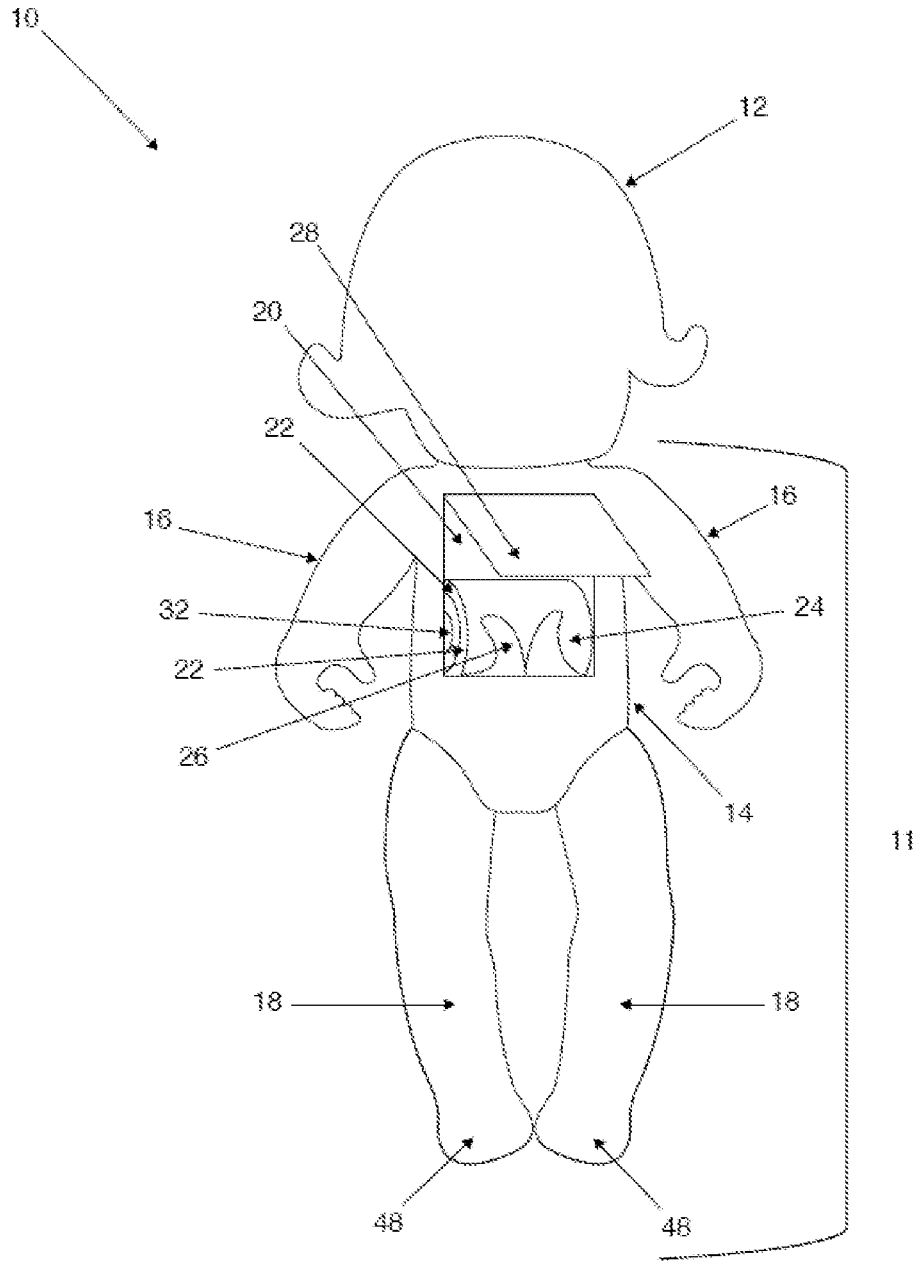
FIG. 13 is an exemplary embodiment of the doll with a cavity having a door in the torso of the doll.
Figure 14:
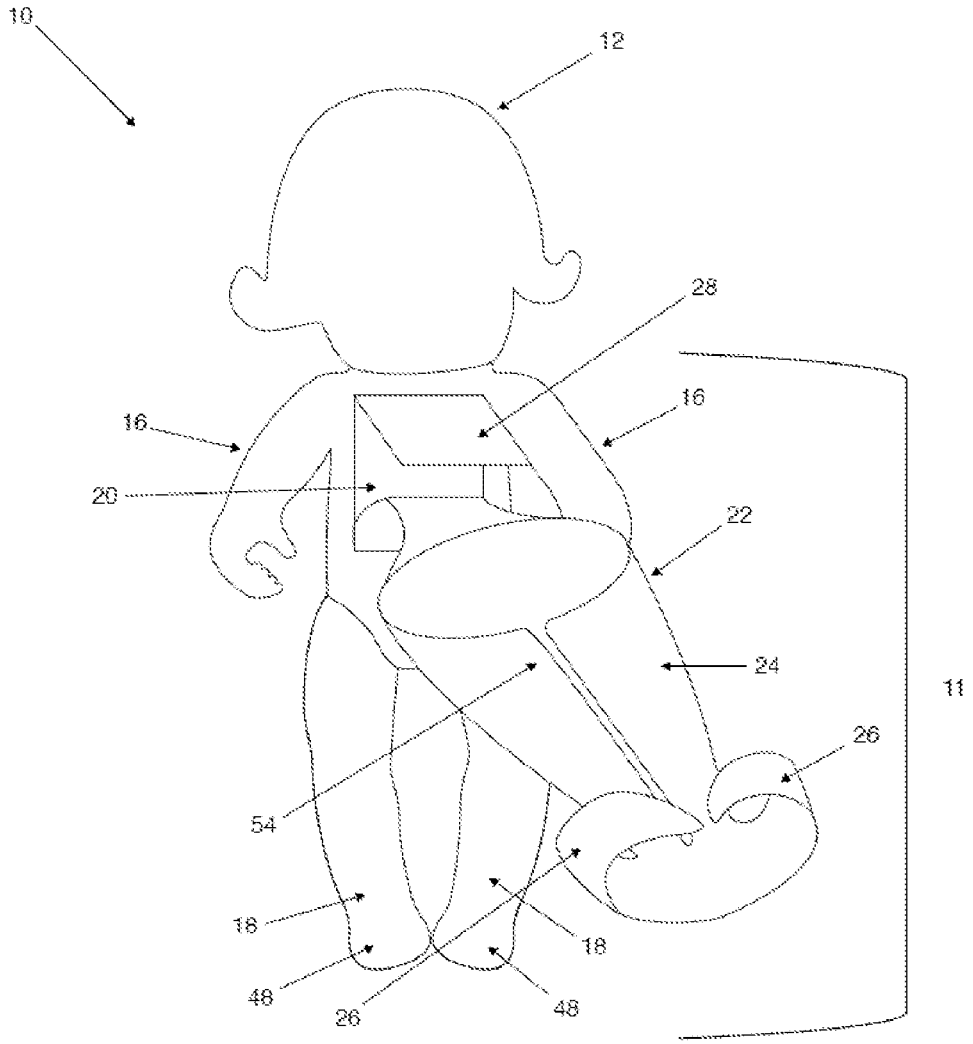
FIG. 14 is an overhead view of the doll of FIG. 13 with the costume element being deployed from the cavity in the torso of the doll.
Figure 15:
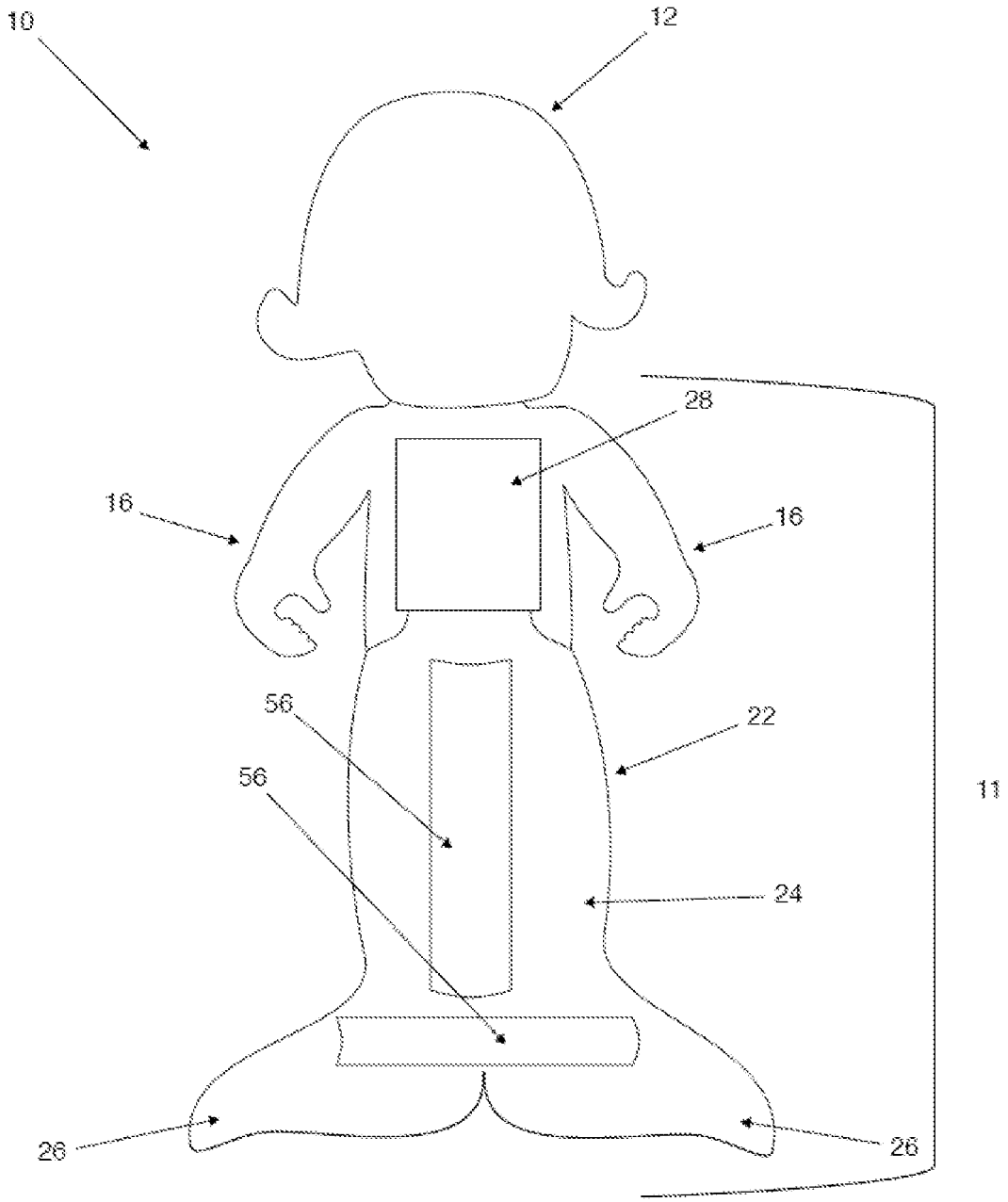
FIG. 15 is an overhead view of the doll of FIG. 13 with the costume element secured on the legs and torso of the doll.

Referring now to FIGS. 13-15, the costume element 22 may be sized to fit within the cavity 20 and the cavity 20 may be open and visible or it may have a door 28 sized to cover the cavity 20 and conceal the costume element 22. The door 28 may be opaque and/or translucent. As seen in FIGS. 13-15, the costume element 22 may be secured within the cavity 20 on a spool 32 or it may be simply folded or rolled-up within the cavity 20 so that it is sized to be releasably secured within the cavity 20.

As shown in FIG. 14, the costume element 22 may be deployed from within the cavity 20 and may be securable to any portion of the body 11. For example, the costume element 22 may be unwound from the spool 32 and once the costume element 22 is deployed, there may be a portion which is at least partially separable 54 using a slit, a seam, or other separable element. The portion of the costume element 22 that is at least partially separable 54 may be separated so that the costume element 22 can be secured to at least a portion of the body 11 or alternatively at least a portion of the costume element 22 may remain within the cavity 20. For example, the mermaid tail may at least be partially separable such that a portion of the tail 24 may be separated and then placed around at least a portion of the legs 18 of the doll 10. At least a portion of the costume element 22 may have a retaining and/or deployment mechanism 30, such as a hook loop fastener, so that once the costume element 22 placed on a portion of the body 11 it may be secured in place. Additionally, all or a portion of the costume element 22 may be rigid, flexible, or semi-rigid to help it stay in place.

Referring now to FIG. 15, the costume element 22 may have the retaining and/or deployment mechanism 30, such as a strip 56, to secure the costume element 22 in place. The strip 56 may include, but not be limited to, a metal strip or other type of rigid and/or semi-rigid strip 56 or structure. The strip 56 may be bendable so that it can be retained within the costume element 22 when it is stored within the cavity 20 and when the costume element 22 is secured around at least a portion of the body 11 or the head 12 the strip 56 may be rigid to help the costume element 22 stay in place. Alternatively, after the costume element 22 is secured to a portion of the body 11, the retaining and/or deployment mechanism 30, such as the strip 56, may be secured to the costume element 22. The costume element 22 may have one strip 56 or more than one strip 56 to secure the costume element 22 in place. As shown in FIG. 15, one strip 56 may be disposed on the tail 24 and a second strip 56 may be disposed on the fluke 26 of the mermaid tail to hold the costume element 22 in place when the costume element 22 is disposed around the legs 18. However, the strip 56 may be placed in any location on the costume element 22. If at least one strip 56 is used, the at least one strip 56 may be inside the costume element 22 such that it is not visible or it may be on an exterior of the costume element 22 that is visible when the costume element 22 is secured to at least a portion of the body 11 of the doll 10.

Figure 16:
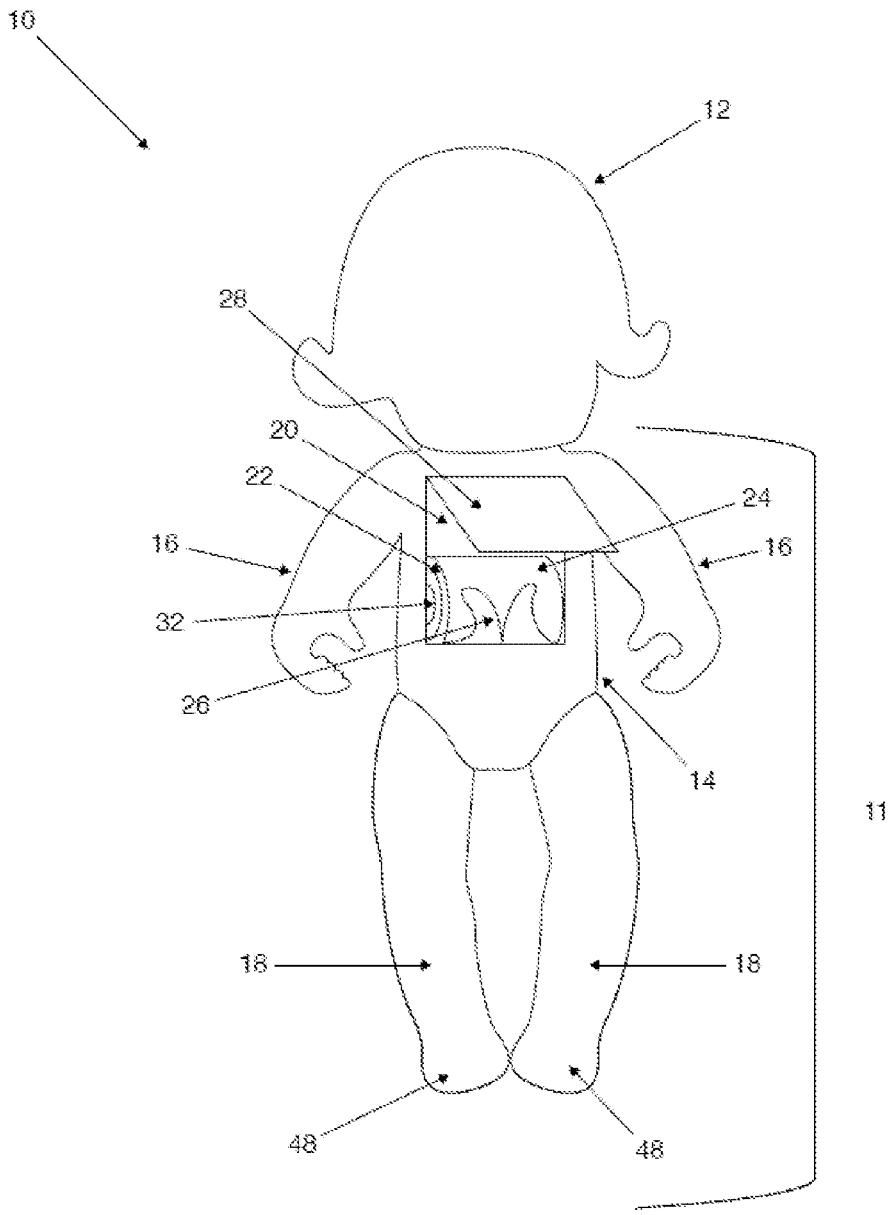
FIG. 16 is an exemplary embodiment of the doll with a cavity having a door in the torso of the doll.
Figure 17:
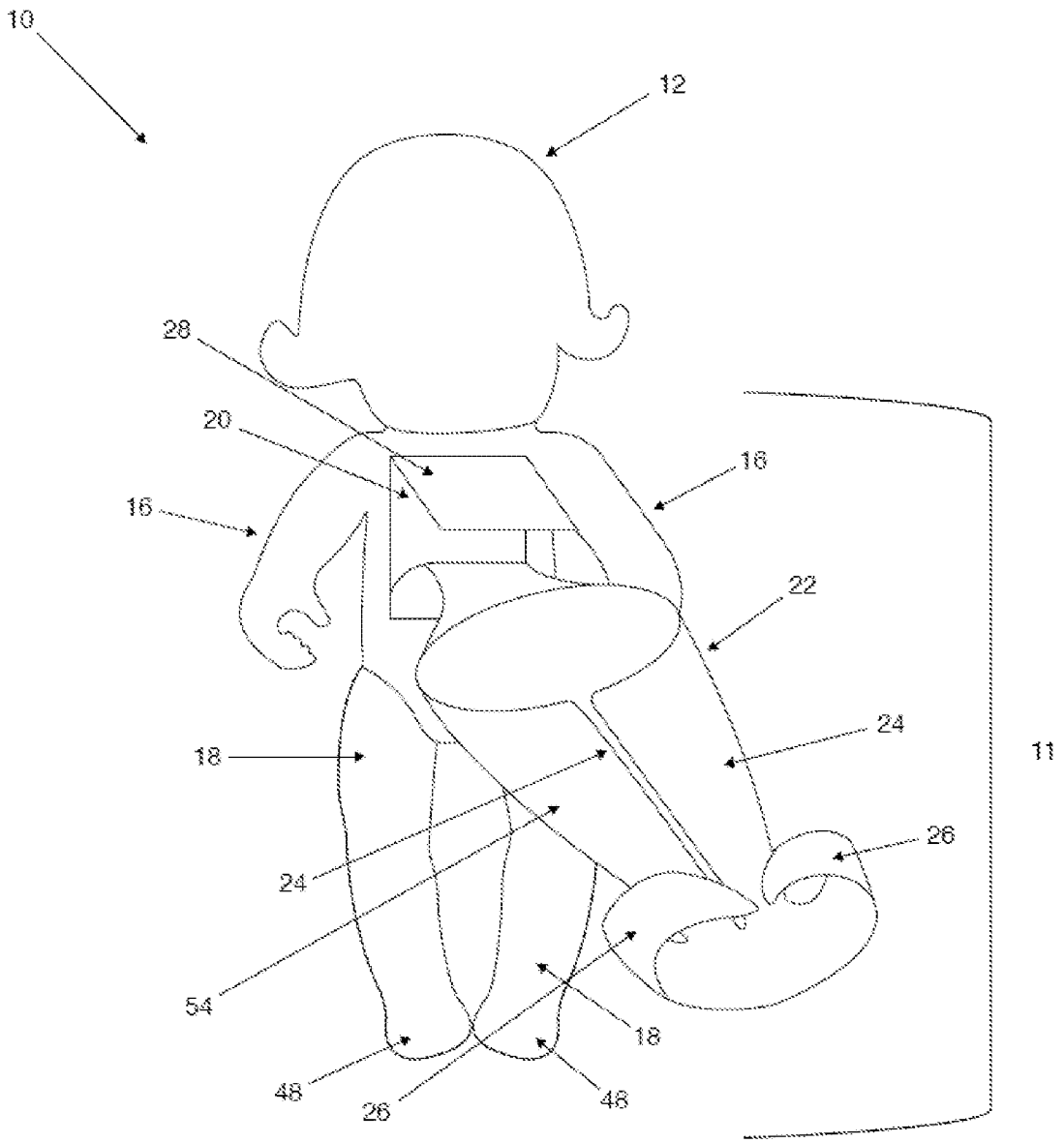
FIG. 17 is an overhead view of the doll of FIG. 16 with the costume element being deployed from the cavity in the torso of the doll.
Figure 18:
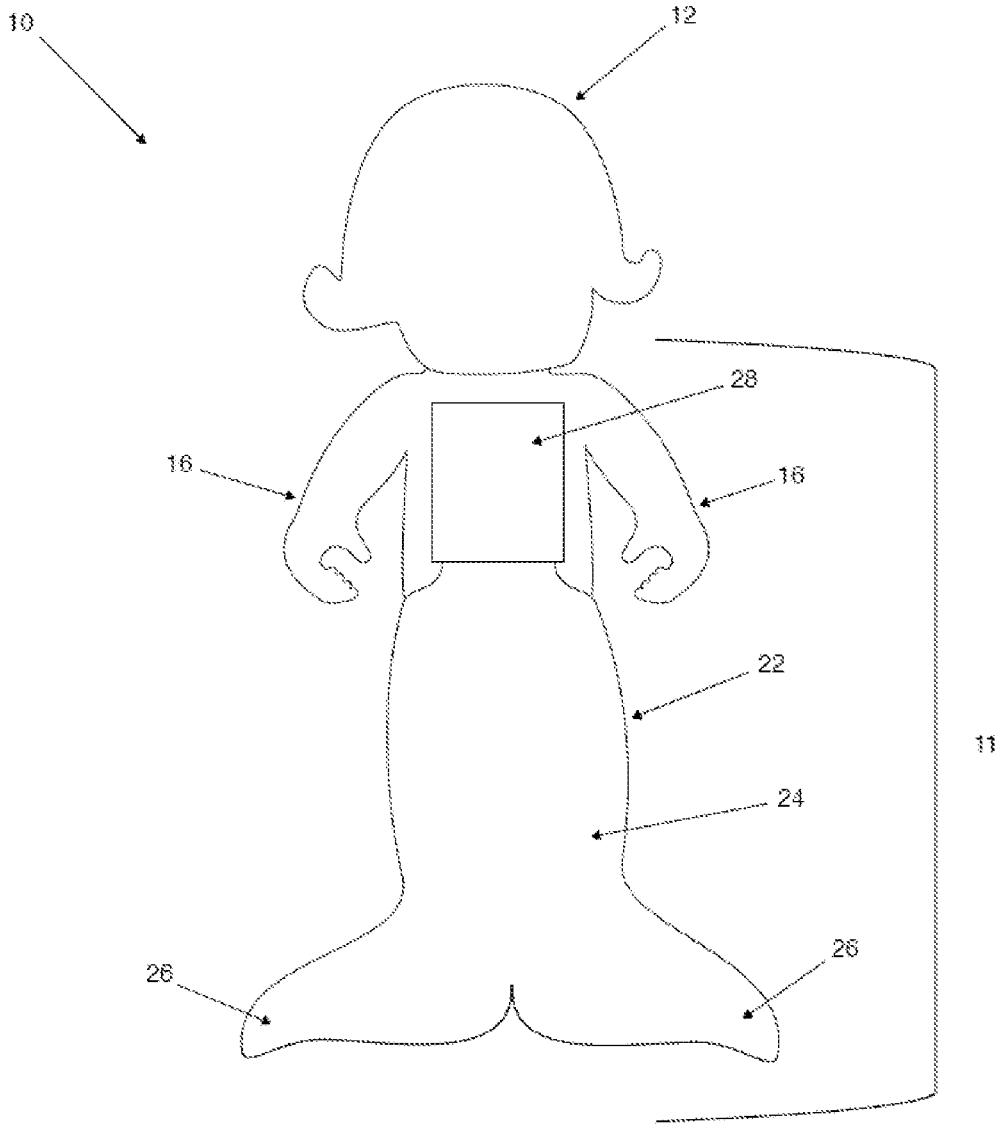
FIG. 18 is an overhead view of the doll of FIG. 16 with the costume element secured on the legs and torso of the doll.

Referring now to FIGS. 16-18, the costume element 22 may be releasably secured to a spool 32 inside the cavity 20. Alternatively, the costume element 22 may be folded up within the cavity 20 or secured within the cavity 20 by another retaining and/or deployment mechanism 30. The costume element 22 may be made from a molded plastic or rubber so that it will stay in place once it is placed on an area of the body 11 without additional retaining and/or deployment mechanisms 30. Inside the cavity 20, the costume element 22 may be compressed, folded, or rolled. If the costume element 22 is secured to a spool 32, the spool 32 may have a retaining and/or deployment mechanism 30 so that the costume element 22 may be automatically rolled around the spool 32.

Figure 19:
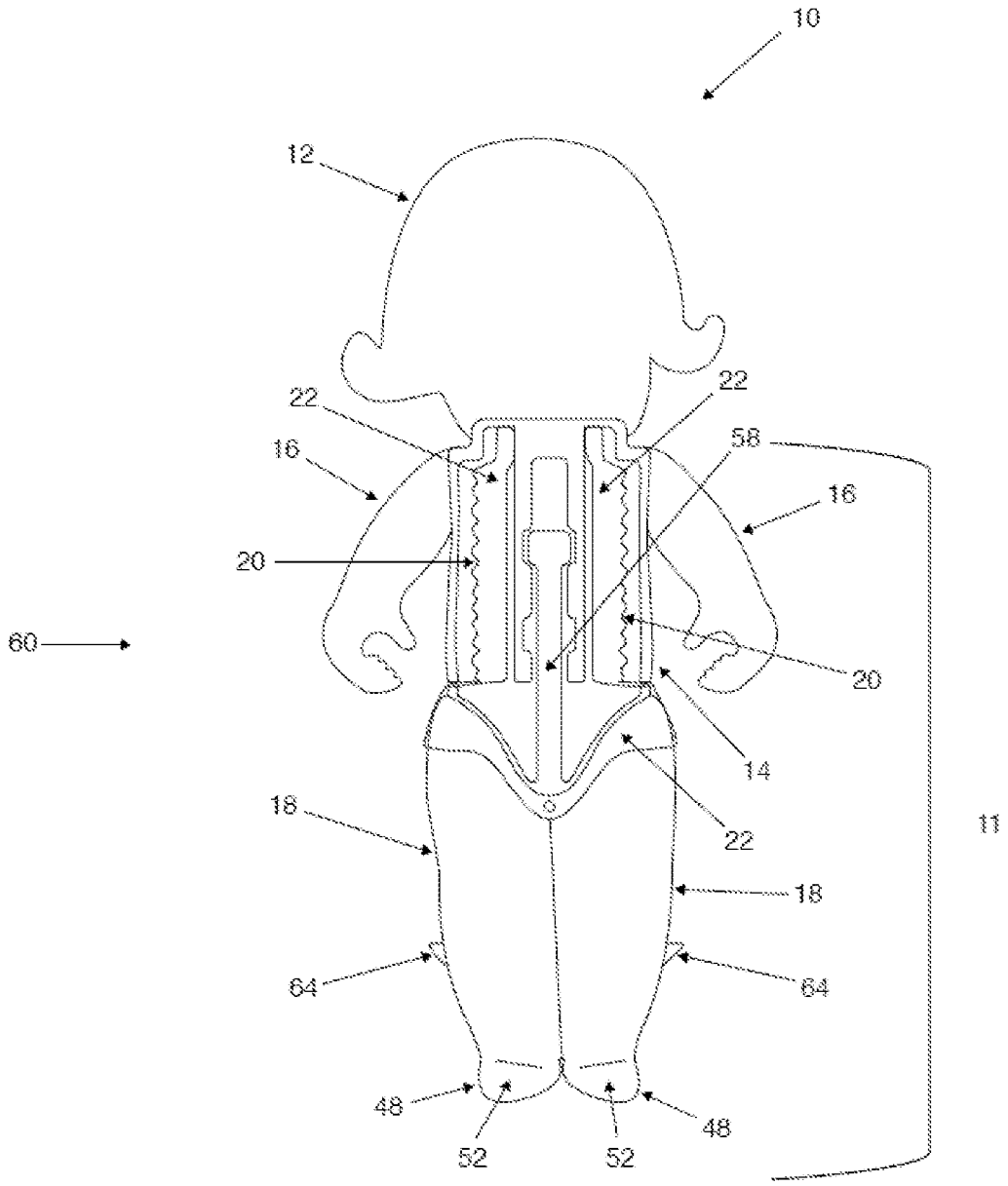
FIG. 19 is another exemplary embodiment of a cross-sectional view of the doll in a first position with the costume element disposed within the cavity.
Figure 20:
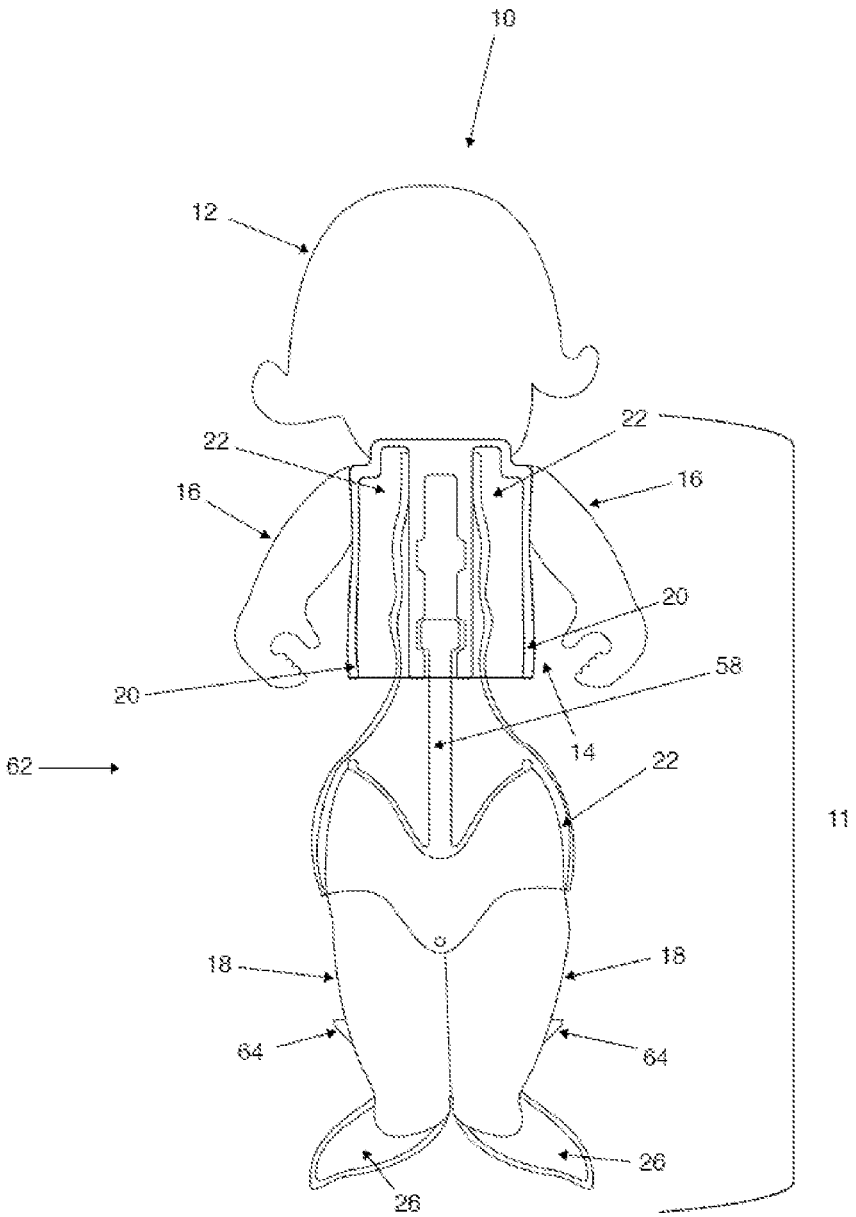
FIG. 20 is a cross-sectional view of the doll of FIG. 19 in a second position with the costume element being deployable from the cavity.
Figure 21:
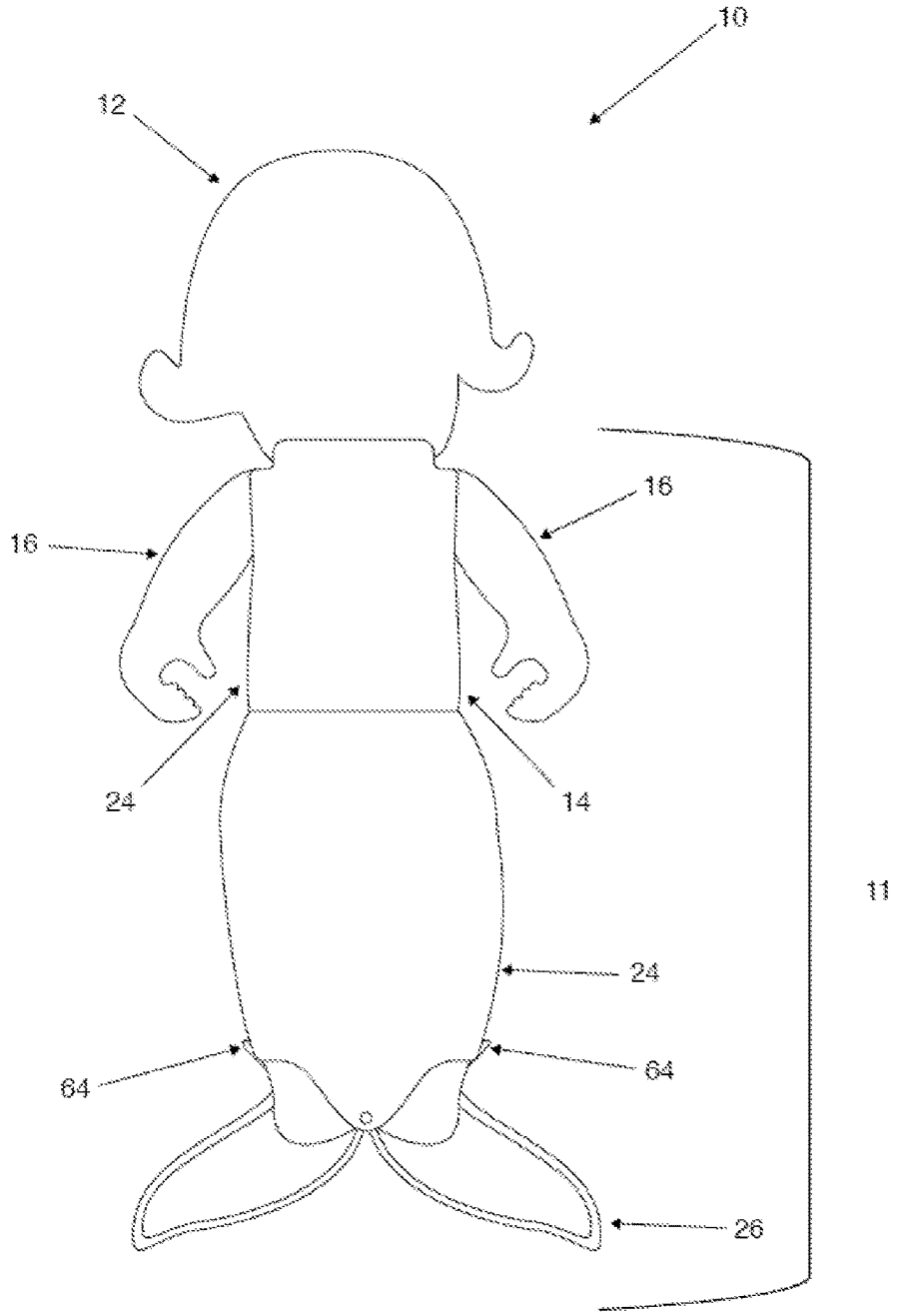
FIG. 21 is an overhead view of the doll of FIG. 19 with the costume element secured to the legs and torso of the doll.

Referring to FIGS. 19-21, the doll 10 may have a torso 14, at least one appendage connected to the torso 14, and a rod 58 disposed within the torso 14. The rod 58 may connect the at least one appendage to the torso 14. The rod 58 may be movable between at least two positions. As shown in FIG. 19, the rod 58 may be movable from a first position A where the torso 14 and the appendage are proximate to each other to a second position B where the torso 14 and appendage are spaced a distance away from each other as shown in FIG. 20. The rod 58 may have a distal end 58A and a proximal end 58B opposite the distal end 58A. The rod 58 may be within the cavity 20 in the torso 14 and may have at least one nub 60. The nub 60 may be part of the rod 58 and/or securable to the rod 58 and in a shape that is different from the shape of the rod 58. For example, the nub 60 may be shaped as a square, a circle, an oval or any other shape and the rod 58 may be shaped as an elongate element such that the nub 60 protrudes from the elongate element shape of the rod 58. The distal end 58B of the rod 58 may have at least one nub 60 and the nub 60 may be sized to fit within a channel 62 disposed within the cavity 20. The channel 62 may have at least one detent 64 sized to receive and retain the at least one nub 60. The nub 60 may be releasably secured within the detent 64 such that the nub 60 may be made out of a material that is compressible.

For example, the doll 10 may be moved from the first position A where the nub 60 is releasably secured within the detent 64 in the channel to the second position B. In the first position A, the nub 60 may be compressed within a first detent 64 and then when the nub 60 is moved to a second detent 64 the doll 10 may be in the second position B. In either the first position A and/or the second position B, the nub 60 may be releasably secured within the detent 64. To create this movement between different positions, the head 12 may be moved in one direction and the legs 18 moved in an opposite direction such that the rod 58 within the channel 62 is moved from one detent 64 within the channel 62 to a second detent 64 in the channel 62. The channel 62 may have multiple detents 64 which may allow the doll 10 to move in many different positions. Alternatively, instead of only moving the head 12 and the legs 18 of the doll 10, any other portion of the body 11 may be moved between a variety of different positions where one appendage is moved in one direction and another appendage is moved in an opposite direction which allows for movement of the nub 60 between different detents 64. This movement may take place manually or automatically at the press of a button or using another retaining and/or deployment mechanism 30 to move doll 10 into different positions.

As shown in FIG. 19, the costume element 22 may be disposed proximate the rod 58. A portion of the costume element 22 may also be disposed outside of the cavity 20 to make it easier to remove the costume element 22 that is disposed inside the cavity 20. Additionally, at least a portion of the costume element 22 may be disposed outside of the cavity 20 to create for example a bikini bottom that may securable or completely separable from the remainder of the costume element 22. In the first position A, the costume element 22 may be completely or at least partially concealed while in the cavity 20. When the doll 10 is in the second position B so that the torso 14 and appendage are spaced a distance away from each other, the costume element 22 may be deployable such that it may be removed from the cavity 20 and placed on the body 11 of the doll 10.

The costume element 22 may be a mermaid tail and the tail 24 may be disposed within the cavity 20 and the fluke 26 may be disposed on at least a portion of an appendage such as the legs 18. The legs 18 may have a separate at least one cavity 20 where the fluke 26 may be disposed and a retaining and/or deployment mechanism 30 may be used to deploy the fluke 26 from the cavity 20 so that it can be secured to a portion of the doll 10. When the fluke 26 is retained within the cavity 20, the retaining and/or deployment mechanism 30 may be disposed in one position and when the retaining and/or deployment mechanism 30 is activated it may be moved to a second position. For example, the retaining and/or deployment mechanism 30 may be a push button that moves from being extended to being depressed when it is pushed. As shown in FIG. 19, the feet 48 may have at least one opening 52 and when the retaining and/or deployment mechanism 30 is activated, the fluke 26 may move from the cavity 20 where it is not visible to the outside of the appendage to form a part of the mermaid tail. Alternatively, the fluke 26 may be secured elsewhere on the doll 10 and once the tail 24 portion of the costume element 22 is removed from the cavity, the fluke 26 may be placed on any portion of the doll 10.

Figure 22:
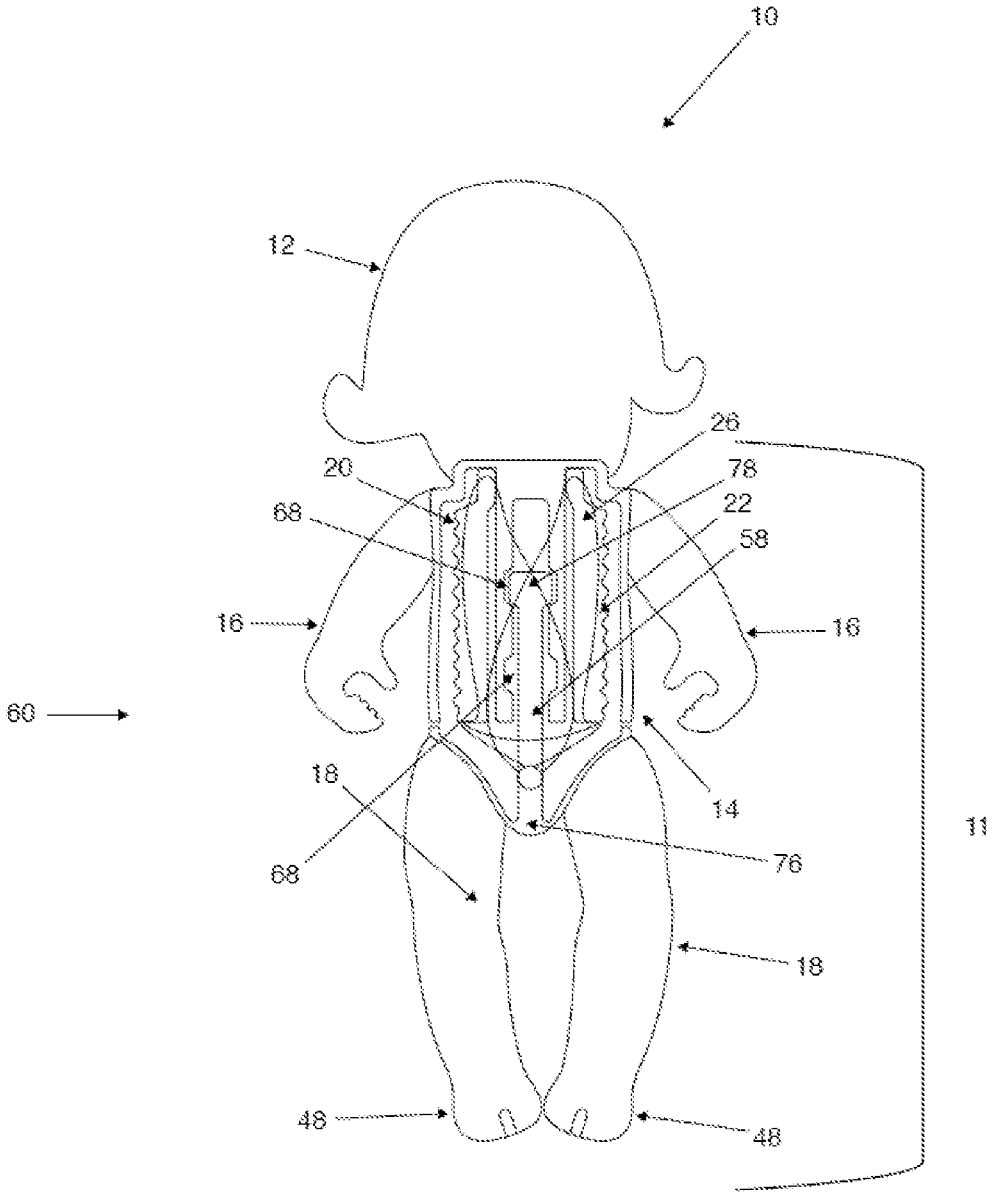
FIG. 22 is an exemplary embodiment of a cross-sectional view of the doll in the first position with the costume element disposed within the cavity.
Figure 23:
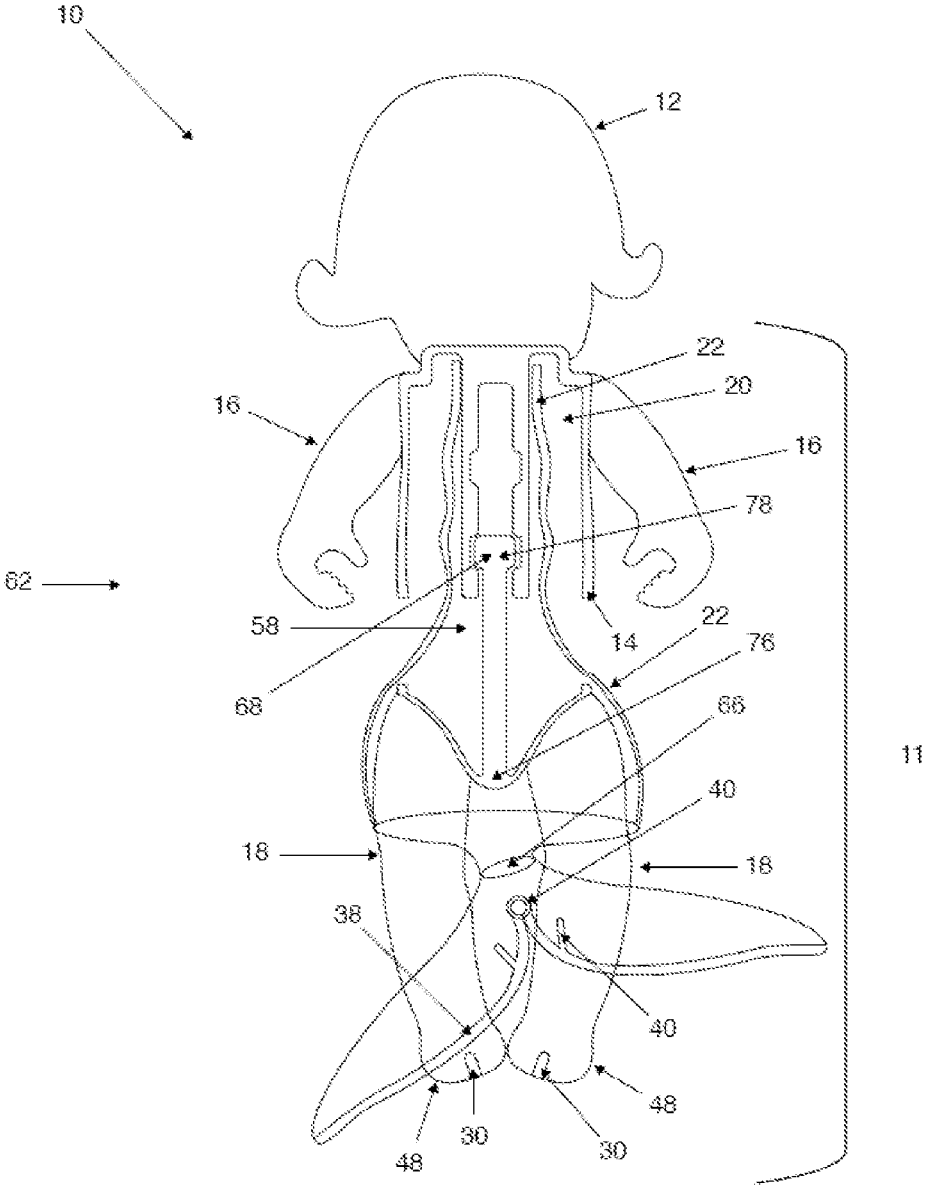
FIG. 23 is a cross-sectional view of the doll of FIG. 22 in the second position with the costume element being deployable from the cavity.
Figure 24:
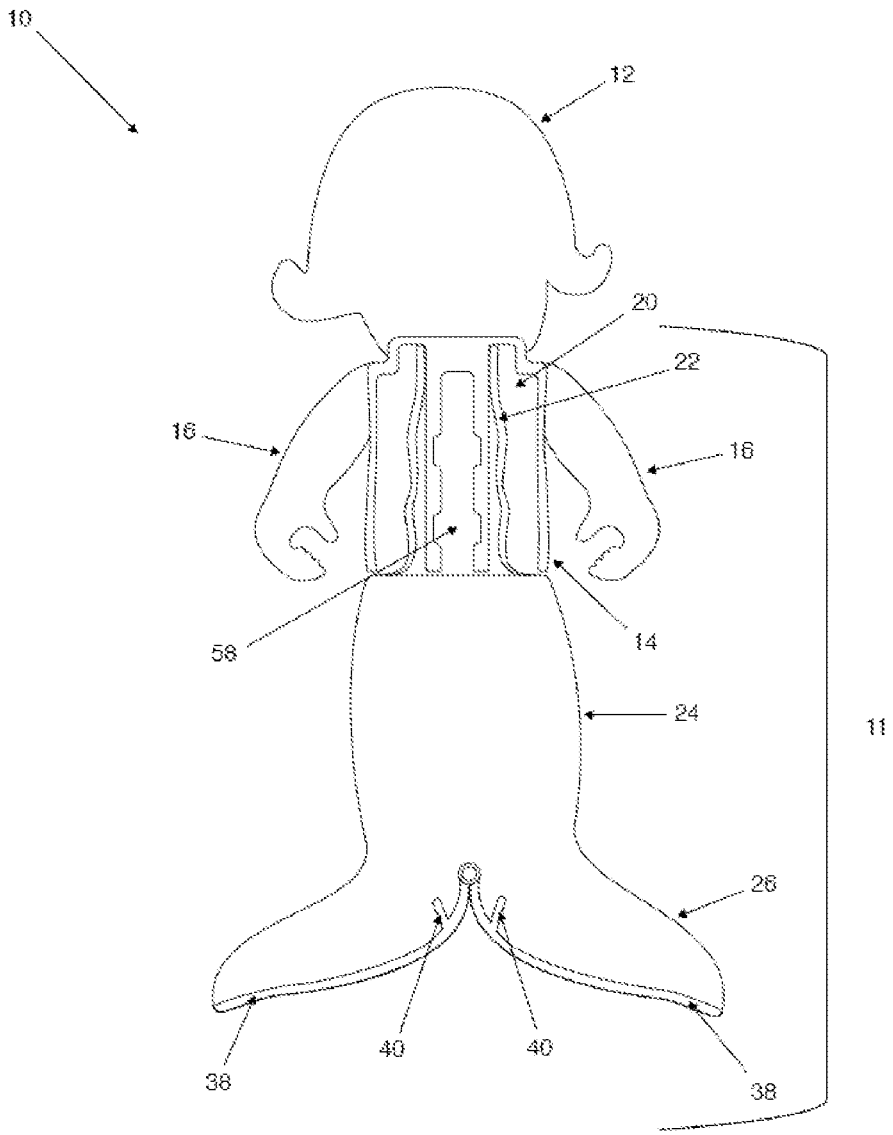
FIG. 24 is an overhead view of the doll of FIG. 22 with the costume element secured to the legs and torso of the doll.

Referring now to FIGS. 22-24, the costume element 22 may be disposed within the cavity 20 and completely concealed. For example, the tail 24 and the fluke 26 may be disposed within the cavity 20 in the torso 14. Alternatively, the cavity 20 may be translucent to show what is inside the cavity 20. The cavity 20 may also have a rod 58 disposed therein which is engaged with at least a portion of the torso 14. The rod 58 may be disposable at least between the first position A and the second position B when the nub 60 on the rod 58 is moved within the channel 62 from a first detent 64 to a second detent 64. In the first position A, the costume element 22 may be completely or partially concealed within the cavity 20.

When the doll 10 is moved from the first position A to the second position B, at least a portion of the costume element 22 may be exposed. In an exemplary embodiment, when the doll 10 is in the second position B, at least a portion of the fluke 26 may be deployed and movable from inside the cavity 20 to an appendage. The fluke 26 may have the opening 52 sized to be retained by at least one foot 48 of the doll 10. The fluke 26 may also have a spine 38 which is rigid and/or semi-rigid and the pin 40 may make the movement of the fluke 26 more realistic. The pin 40 may also be secured within the retaining and/or deployment mechanism 30. At least one pin 40 may be disposed between the two fins of the fluke 26 to make the fluke 26 movable and another pin 40 may be disposed on a different portion of the fluke 26 and may be securable to the retaining and/or deployment mechanism 30 on the foot 48 of the doll 10. Once the costume element 22 is deployed from the cavity 20, the rod 58 may be disposed in the first position A.

Figure 25:
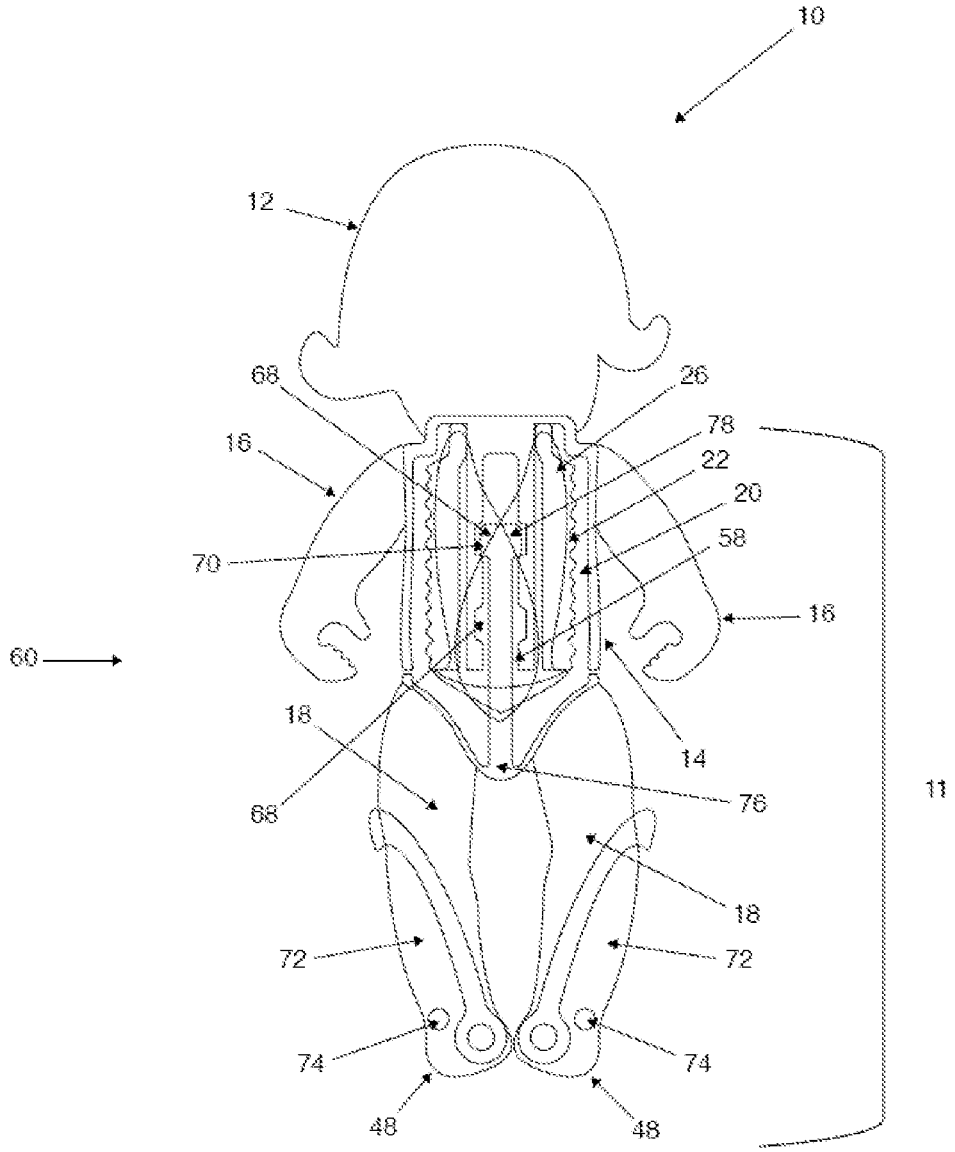
FIG. 25 is an exemplary embodiment of a cross-sectional view of the doll in the first position with the costume element disposed within the cavity.
Figure 26:
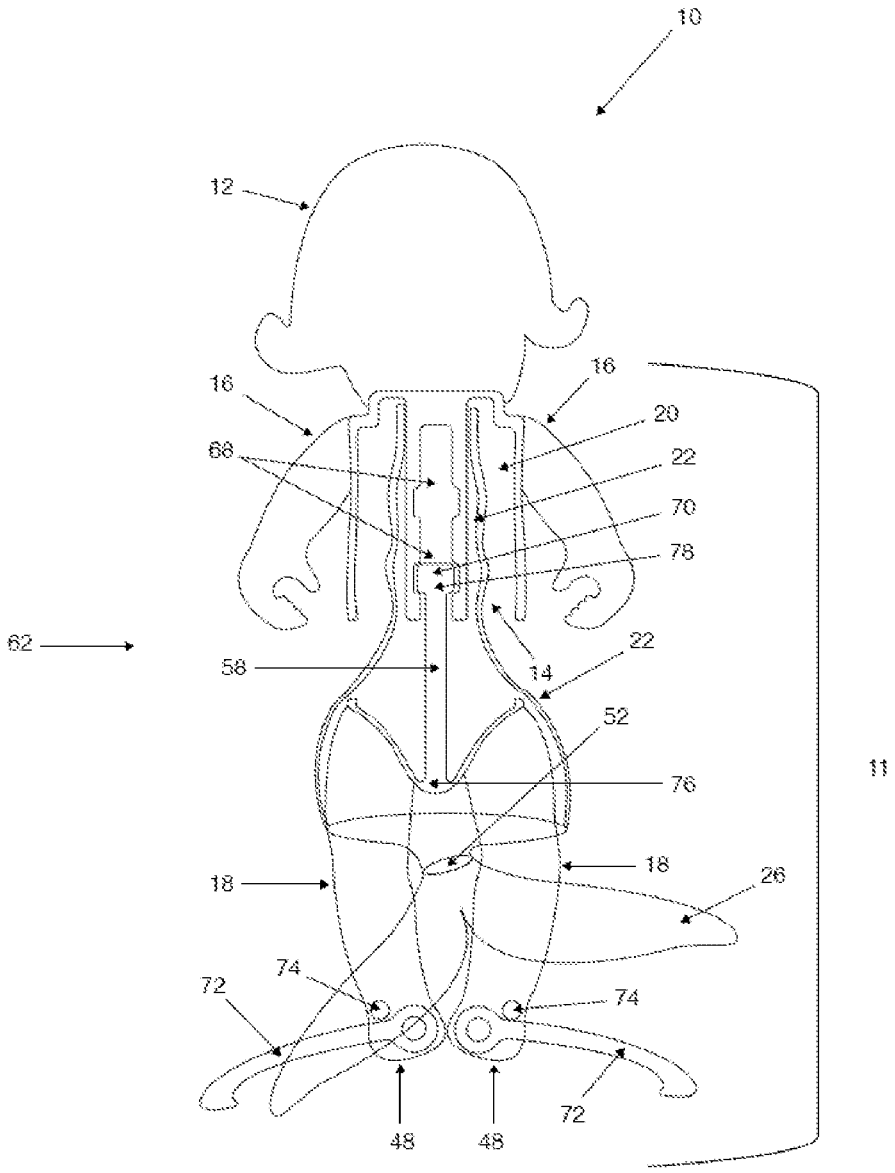
FIG. 26 is a cross-sectional view of the doll of FIG. 25 in the second position with the costume element being deployable from the cavity.
Figure 27:
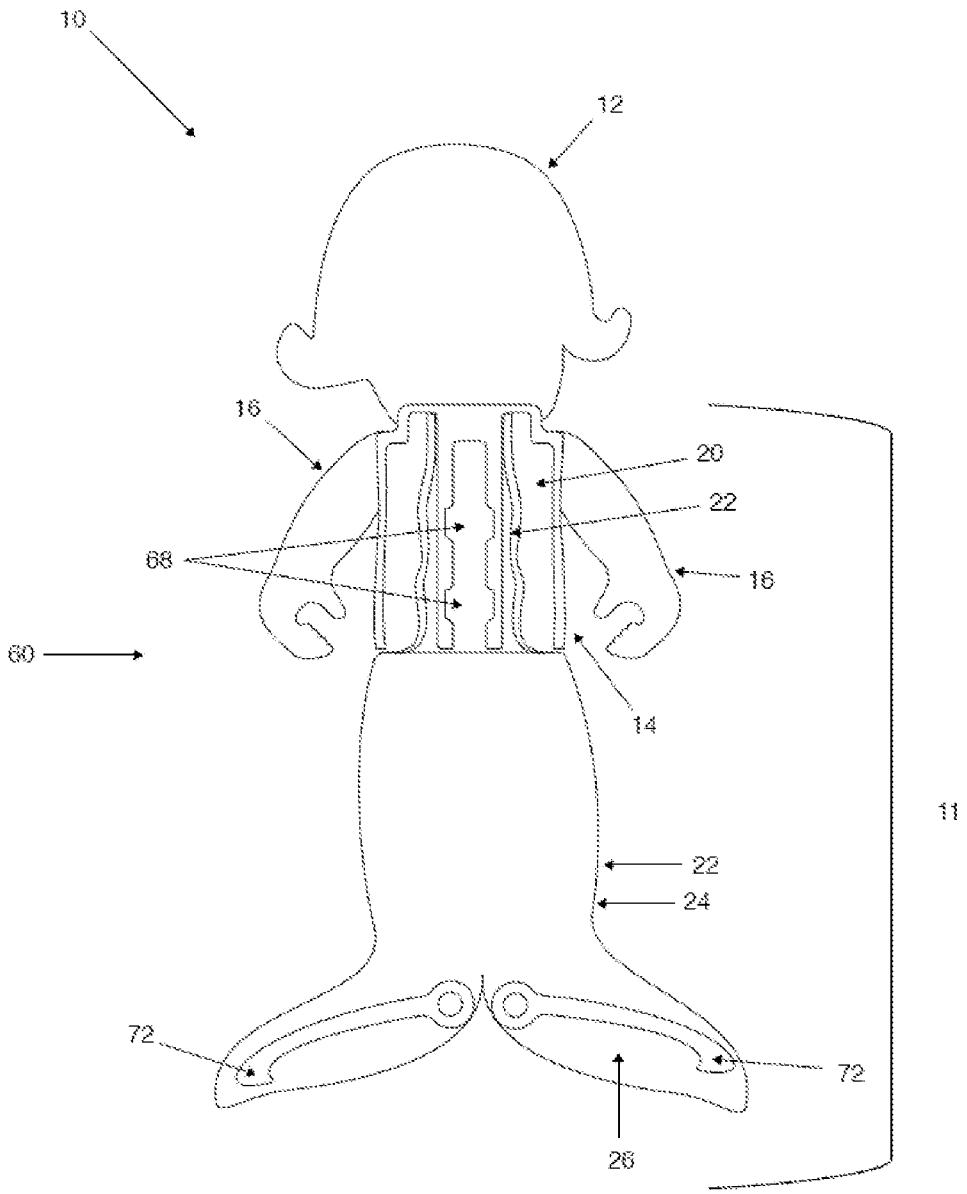
FIG. 27 is an overhead view of the doll of FIG. 25 with the costume element secured to the legs and torso of the doll.

Referring now to FIGS. 25-27, in another configuration, in the first position A, the costume element 22 may be concealed and within a cavity 20 which may be disposed in the body 11 of the doll 10. When the doll 10 is moved from the first position A to the second position B, the costume element 22 may become exposed to allow it to be placed anywhere on the doll 10. In an exemplary embodiment, the costume element 22 may be the tail 24 and the fluke 26. When the doll 10 is in the second position B, the tail 24 may be deployed from the cavity 20 in the torso 14 to cover the legs 18 of the doll. Additionally, the fluke 26 may be deployed and be releasably secured to at least one appendage. For example, the fluke 26 may be deployed from the cavity 20 and moved toward the feet 48 of the doll 10. The doll 10 may have at least one movable arm 72 sized to secure at least a portion of the costume element 22 to the doll 10. The movable arm 72 may be various sizes and shapes depending upon the size and shape of the costume element 22 to be secured by the movable arm 72. The doll 10 may also have a retaining and/or deployment mechanism 30, which may secure the movable arm 72 in place and also deploy the movable arm 72 so that it may move into various positions. For example, after the costume element 22 is removed from the cavity 20 and the fluke 26 is moved toward the feet 48 of the doll 10, the movable arm 72 may be deployed into a desired position and the retaining and/or deployment mechanism 30 may be activated to retain the movable arm 72 in position. In this example, the retaining and/or deployment mechanism 30 may be a button or lever to control the movement of the movable arm 72. A portion of the costume element 22 or the entire costume element 22 may be secured in place on the doll 10 using a movable arm 72.

Figure 28:
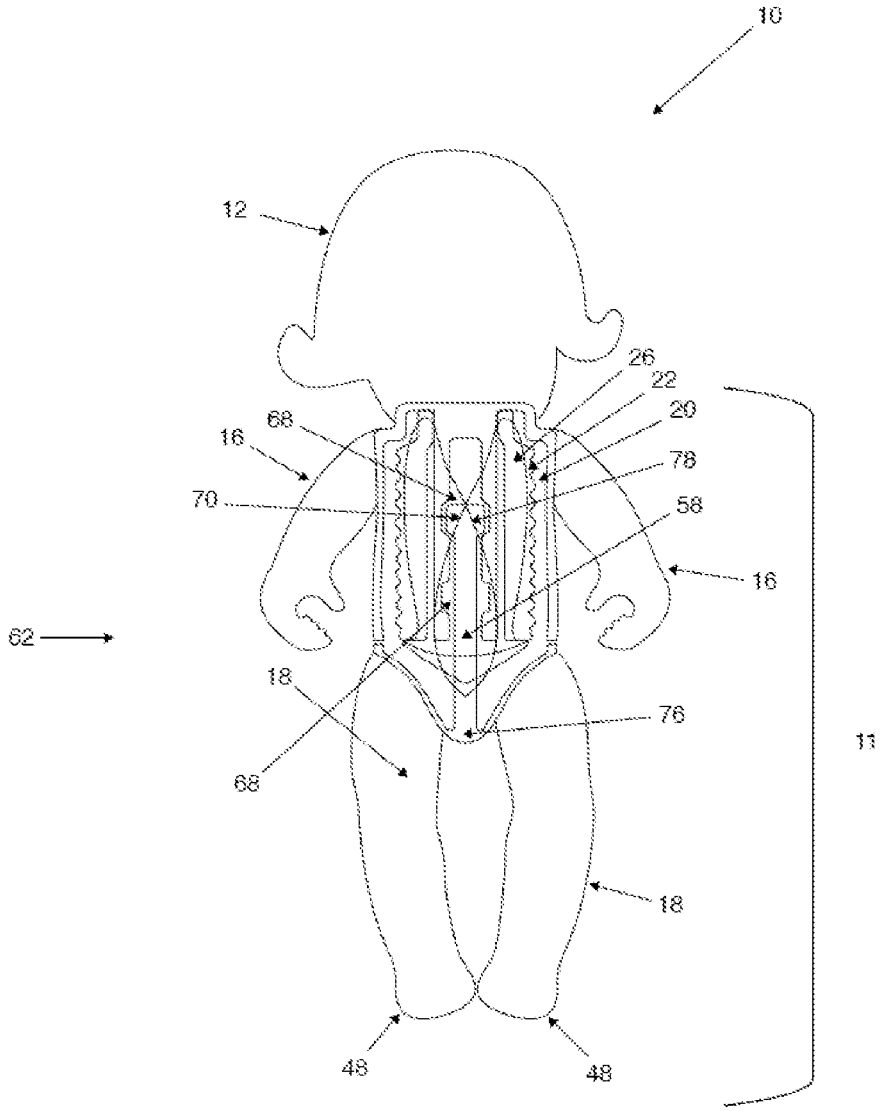
FIG. 28 is an exemplary embodiment of a cross-sectional view of the doll in a first position with the costume element disposed within the cavity.
Figure 29:
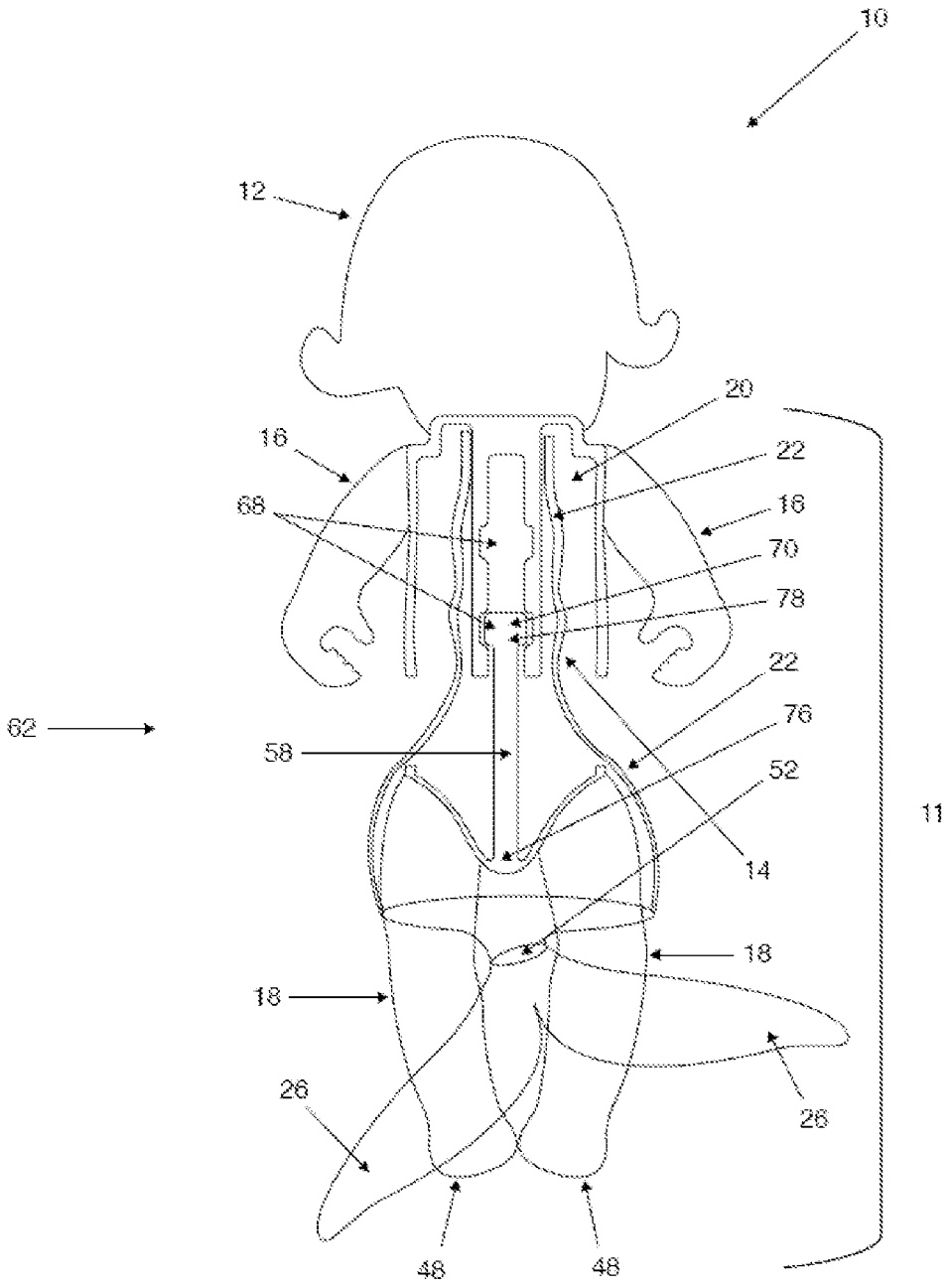
FIG. 29 is a cross-sectional view of the doll of FIG. 27 in the second position with the costume element being deployable from the cavity.
Figure 30:
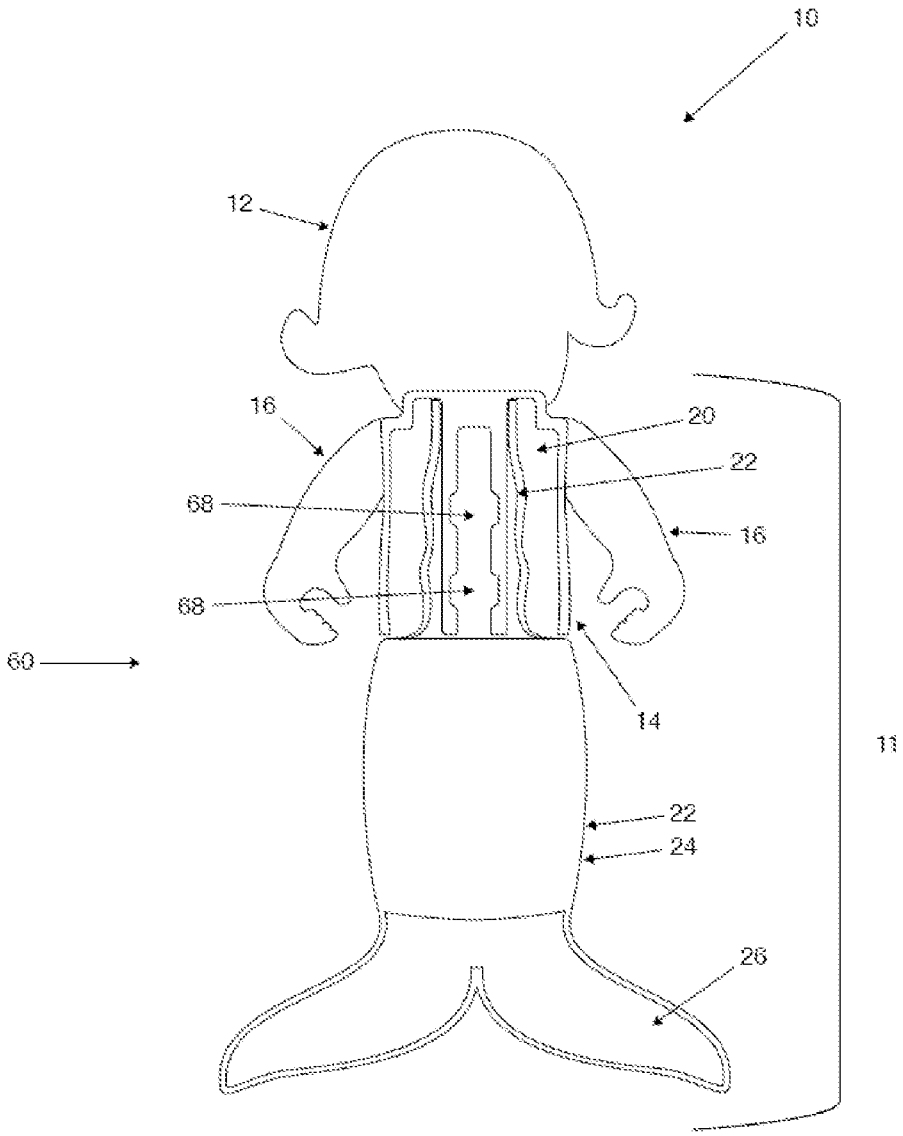
FIG. 30 is an overhead view of the doll of FIG. 27 with the costume element secured to the legs and torso of the doll.
Figure 31:
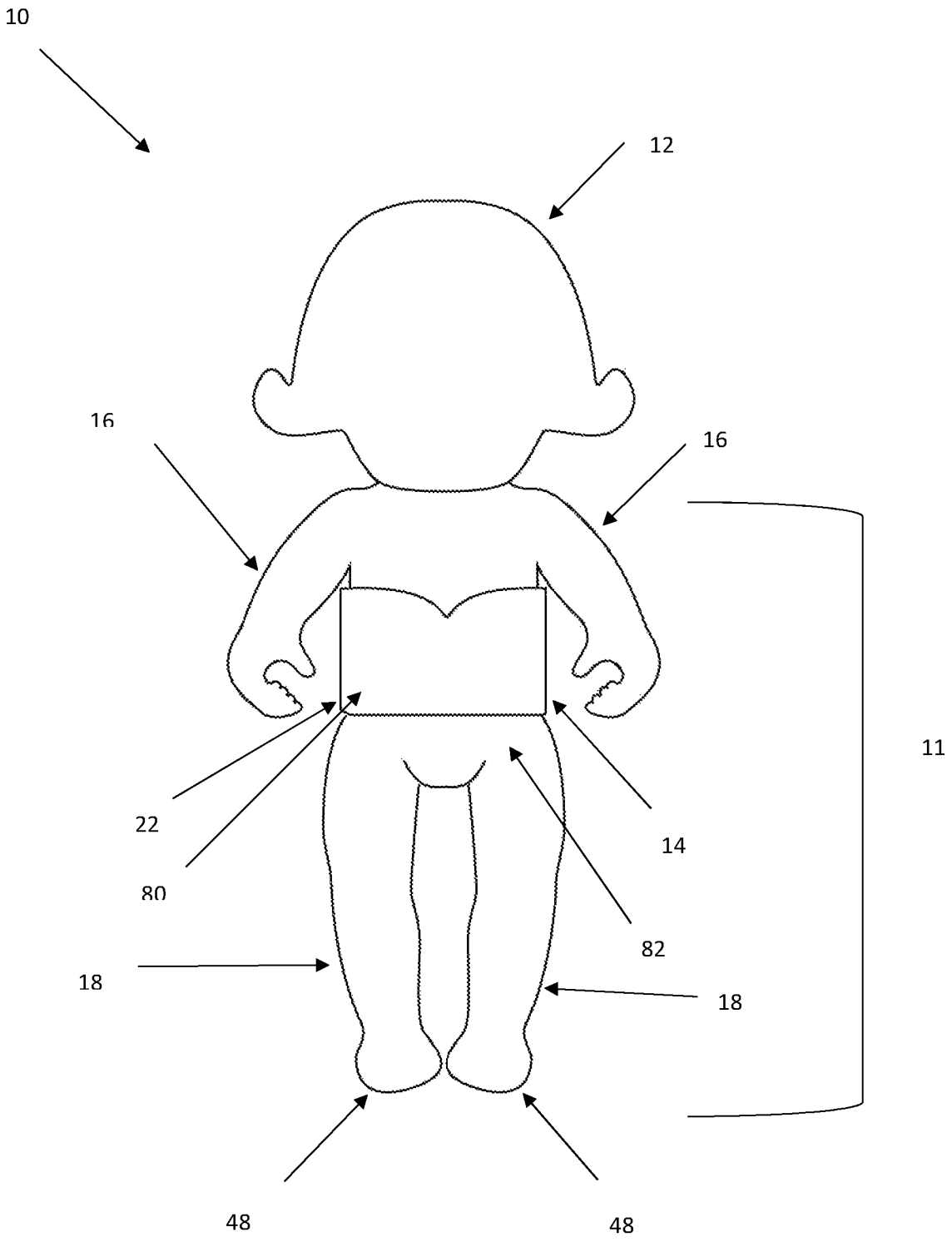
FIG. 31 is an exemplary embodiment of a front view of the doll with at least a portion of the costume element disposed within the cavity and at least a portion of the costume element disposed outside of the cavity.

Now referring to FIGS. 28-30, in this embodiment, when the doll 10 is in the first position A, the costume element 22 may be concealed within the cavity 20. When the doll 10 is in the second position B, the costume element 22 may be exposed and movable. In an exemplary embodiment, the costume element 22 may be a mermaid tail which may be secured over the legs 18 of the doll 10. When the costume element 22 is deployed from within the cavity 20, the fabric from the costume element 22 may be pulled to cover the legs 18. For example, the fluke 26 may have an opening 52 sized to be secured to at least a portion of the foot 48 of the doll 10. The tail 24 and the fluke 26 may be secured together to create a single unit or may be separable. Additionally, at least a portion of the costume element 22 may be made from foam or another type of material to allow shape retention within the fabric.

Now referring to FIGS. 31-38, in this embodiment, at least a portion of the costume element 22 may be disposed within the cavity 20. The cavity 20 may refer to one cavity 20 or more than one cavity 20. Alternatively, the entire costume element 22 may be disposed within the cavity 20. If at least a portion of the costume element 22 is at least partially disposed outside of the cavity 20, that portion of the costume element 22 disposed outside of the cavity may be placed on or secured around a portion of the body 11 to create, for example, an accessory item 80 including, but not limited to, a headband, a hat, a belt, a corset, or a bodice. As a non-limiting example, the costume element 22 may be a tail 24 and a fluke 26 and the tail 24 may be at least partially disposed within the cavity 20. The fluke 26 may be disposed entirely within the cavity 20, at least partially within the cavity 20, and/or entirely outside of the cavity 20. For example, if the fluke 26 is disposed outside of the cavity 20, the fluke 26 may be wrapped around the torso 14 to create a belt, corset, bodice, or other accessory item 80. Wrapping the fluke 26 around the torso 14 may conceal any portion of the costume element 22 disposed inside of the cavity 20. Alternatively, the accessory item 80 may be completely separable from the costume element 22 and the accessory item 80 may be used to conceal or cover a portion of the body 11. If any portion of the cavity 20 is visible, the accessory item 80 may cover the cavity 20.

Figure 32:
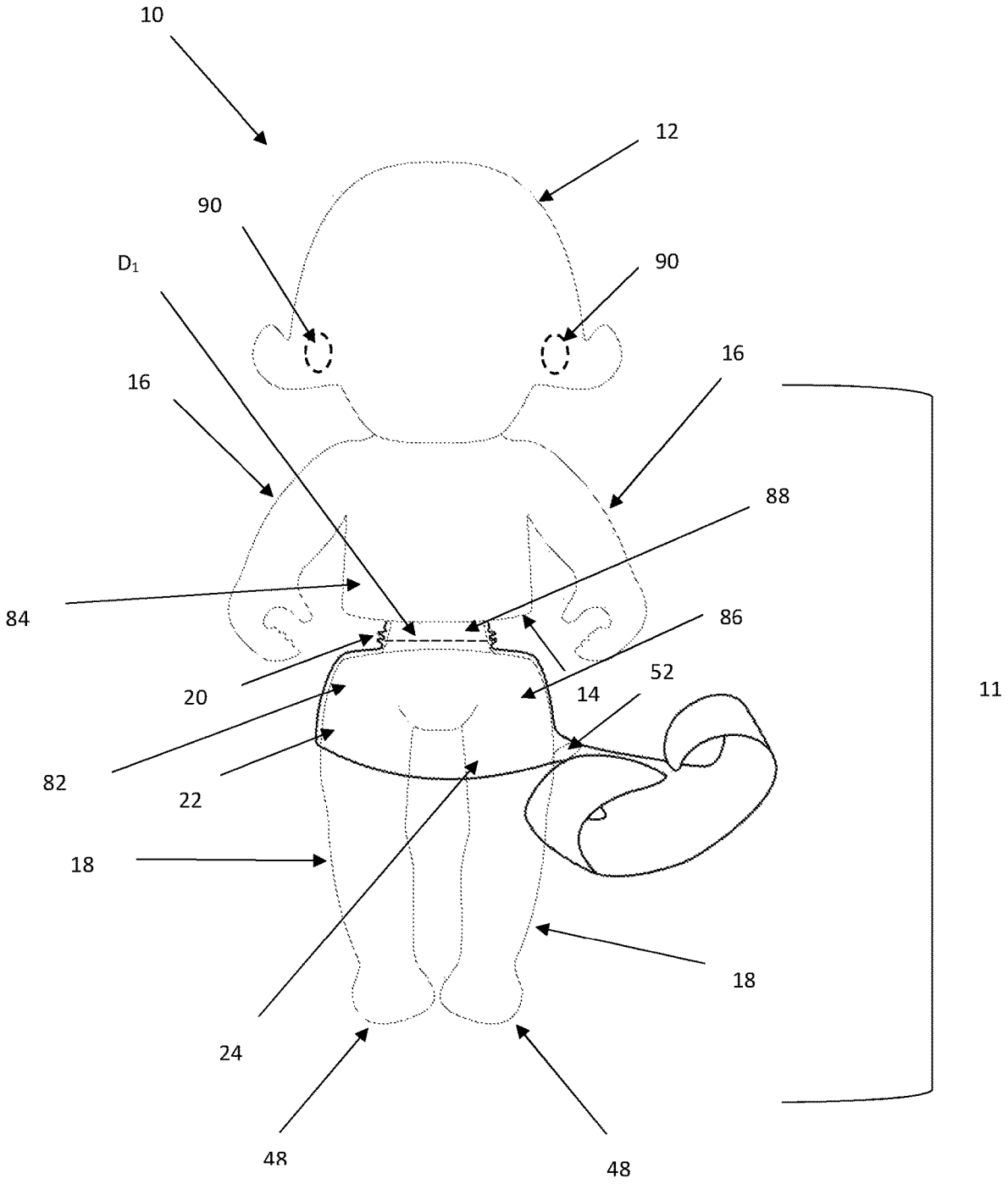
FIG. 32 is a front view of the doll of FIG. 31 with the costume element being deployable from within the cavity.
Figure 33:
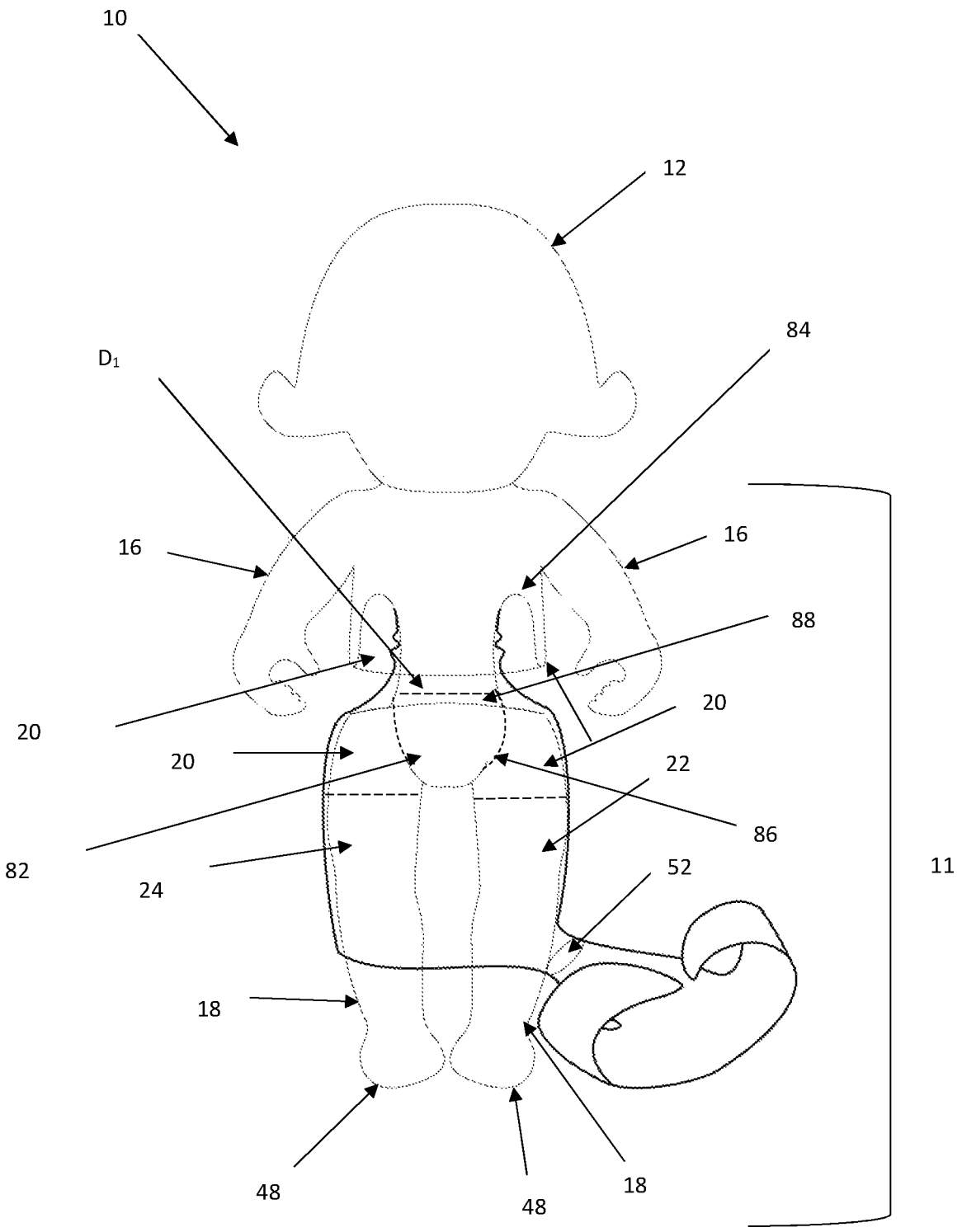
FIG. 33 is a cross-sectional view of the doll of FIG. 31 with the costume element being deployable from within the cavity.
Figure 34:
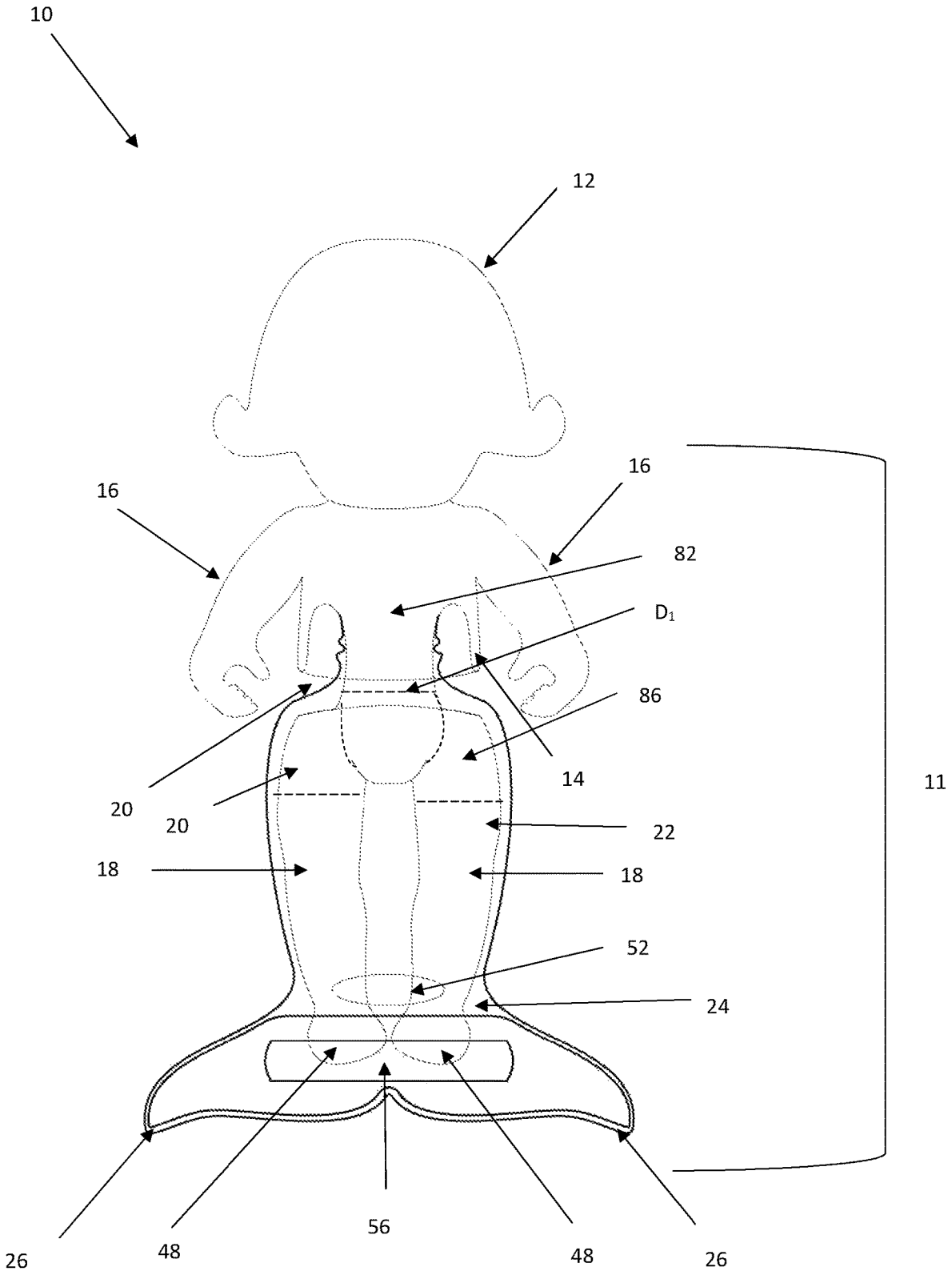
FIG. 34 is a cross-sectional view of the doll of FIG. 31 with the costume element secured to the legs and torso of the doll.

Now referring to FIGS. 32-34, the costume element 22 may be deployed from within the cavity 20. At least a portion of the costume element 22 may be secured within the cavity 20 with the retaining and/or deployment mechanism 30, including but not limited to a hook, a clip, an elastic, an adhesive, or another device configured to retain and/or secure the costume element 22. The doll 10 may have a first section 84 and a second section 86 and the first section 84 and the second section 86 may define a cavity 20 therebetween. The first section 84 and the second section 86 may be joined by a connecting section 88. At least a portion of the first section 84 and/or at least a portion of the second section 86 may also be at least partially hollow and define a cavity 20. For example, the first section 84 may be at least a portion of the torso 14 of the doll 10, the second section 86 may at least a portion of the waist 82, and the connecting section 88 may be the spine or another internal structure within the doll. The connecting section 88 may have a diameter Di that is sufficiently small so that the connecting section 88 does not completely fill the cavity 20 in the first section 84, the second section 86, and the cavity 20 between the first section 84 and the second section 86. This may allow the costume element 22 to fit completely or partially within any of the cavities 20 within or between the first section 84 and the second section 86. The diameters of the first section 84 and the second section 86 may be larger than the diameter Di of the connecting section 88.

The first section 84 and the second section 86 may be movable along the connecting section 88 vertically, horizontally, or at an angle so that any cavity 20 between and within the first section 84 and the second section 86 may be completely concealed. For example, if the costume element 22 is placed within the cavity 20 in the first section 84 and/or in the cavity 20 in the second section 86 and at least a portion of the costume element 22 is visible in the cavity 20 between the first section 84 and the second section 86, the first section 84 and the second section 86 may be moved along the connecting section 88 so that any cavity 20 is concealed by the first section 84 and the second section 86. Also, this vertical, horizontal, or angled movement may allow access to any cavity 20. Alternatively, the first section 84 and the second section 86 may not be movable and remain stationary. Any similar arrangement may be made between the head 12 and the torso 14 such that the costume element 22, such as a cape, may be deployed or concealed within the cavity 20. Alternatively, a similar arrangement may be made between at least one arm 16 and the torso 10 so that the costume element 22, such as sleeves, may be deployed or concealed, between at least one ear 90 and the head 12 so that the costume element, such as earrings or a head covering, may be deployed or concealed, between the waist 82 and at least one leg 18 to allow the costume element 22, such as leg coverings, to be deployed or concealed, and/or between at least one leg 18 and at least one foot 48 so that the costume element, such as a shoe or other foot covering, may be deployed or concealed.

Continuing to refer to FIGS. 32-34, any portion of the costume element 22 that is secured to a portion of the body 11, for example as an accessory item 80, and is not within the cavity 20, may be movable. For example, the strip 56 may be secured within the costume element 22 so that the costume element 22 can be deformed into different positions and secured around the body 11. If the costume element 22 is a fluke 26 and a tail 24, the strip 56 may be disposed within the fluke 26 so that the fluke 26 may be deformed to surround the torso 14, may be deformed to remove the fluke 26 from the torso 14, and may be deformed into another position so that the fluke 26 can be moved into any number of positions. Alternatively, the costume element 22, such as the fluke 26, may be made from material that is deformable into a variety of different positions without the strip 56. The tail 24 may be made from material including deformable fabrics like synthetic elastane fiber, cotton, wool, plastic, or polyester. As shown in FIG. 32, a portion of the tail 24 may be secured to the connecting section 88, and the tail 24 may be hollow on the inside, like a tube, such that the tail 24 may surround the connecting section 88 and the deformable material in the tail 24 be pulled down from the connecting section 88 toward the feet 48 to cover the legs 18. The costume element 22 may have an opening 52 that can be a variety of different sizes and shapes. For example, the tail 24 and/or fluke 26 may have an opening 52 that is sized to receive the feet 48 of the doll 10. The opening 52 may stretchable and deformable so that the feet 48 of the doll 10 can fit within the opening 52 of the costume element 22. For example, the hollow portion of the tail 24 may be moved from the connecting section 88 down toward the feet 48 and the opening 52 may be deformed to secure the tail 24 over the feet 48 of the doll 10. The opening 52 may be visible when it is being deformed, but when tension is removed from the opening 52, the material may conceal the opening 52 so that the costume element 22 appears smooth and the opening 52 is not visible. The opening 52 may be disposed anywhere on the costume element 22. For example, the tail 24 may have a front side and a back side which is opposite the front side, and the front and back side may be secured together to create the hollow tube. The opening 52 on the tail 24 and/or fluke 26 may be on the back side of the tail 24 and/or fluke 26 so that it is not as visible on the front side. The material in the costume element 22 may also be stretchable to enlarge the opening 52 so that any body part, including the legs 18 and feet 48, can easily fit through the opening. Once the costume element 22 is in place and covering at least a portion of the doll 10, any excess material inside the cavity 20 may be removed by pulling on the costume element 22 toward the any body part requiring additional material. If there is excess material from the costume element 22 that remains in the cavity 20 after the costume element 22 is pulled over a part of the body 11, the cavity 20 may conceal the excess material. Alternatively, the first section 84 and the second section 86 may be moved to conceal the cavity 20. Once the costume element 22 is in place over at least a portion of the body 11, additional changes may be made to the costume element 22. As a non-limiting example, when the tail 24 is covering the legs 18 and feet 48 of the doll 10, the strip 56 within the fluke 26 may be deformed in any configuration. As shown in FIG. 34, the strip 56 may be flattened so that the fluke 26 stays open or into other positions as well.

Figure 35:
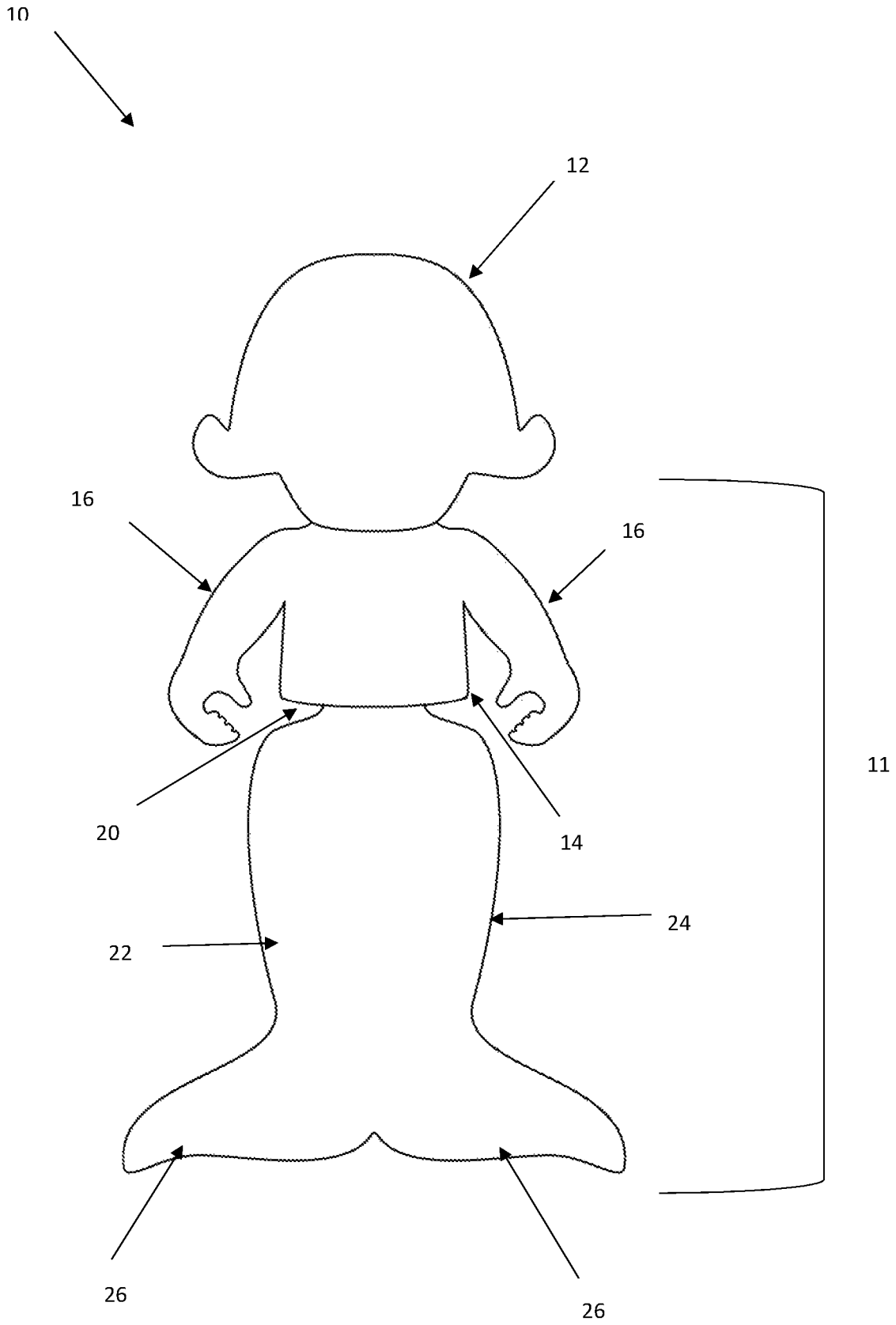
FIG. 35 is a front of the doll of FIG. 31 with the costume element secured to the legs and torso of the doll.

As shown in FIGS. 34-35, at least a portion of the costume element 22 may have strip 56. The strip 56 may be concealed inside at least a portion of the costume element 22. For example, if the costume element 22 includes the tail 24 and fluke 26, the fluke 26 may have the strip 56 secured within the fluke 26. The strip 56 may be disposed between two pieces of foam or another type of material to secure the strip 56 in place within the costume element 22 and the foam or other material may be covered/concealed by additional material including fabric. The foam or other material can be made in any shape, including into the shape of the fluke 26, and may be flexible and bendable in different directions. Once the strip 56 is deformed into a particular position it may remain in that position until it is moved into a different position. For example, the strip 56 may include layered, flexible stainless steel bistable spring bands or alternatively may be made from a malleable metal, plastic, rubber or other deformable material.

Figure 36:
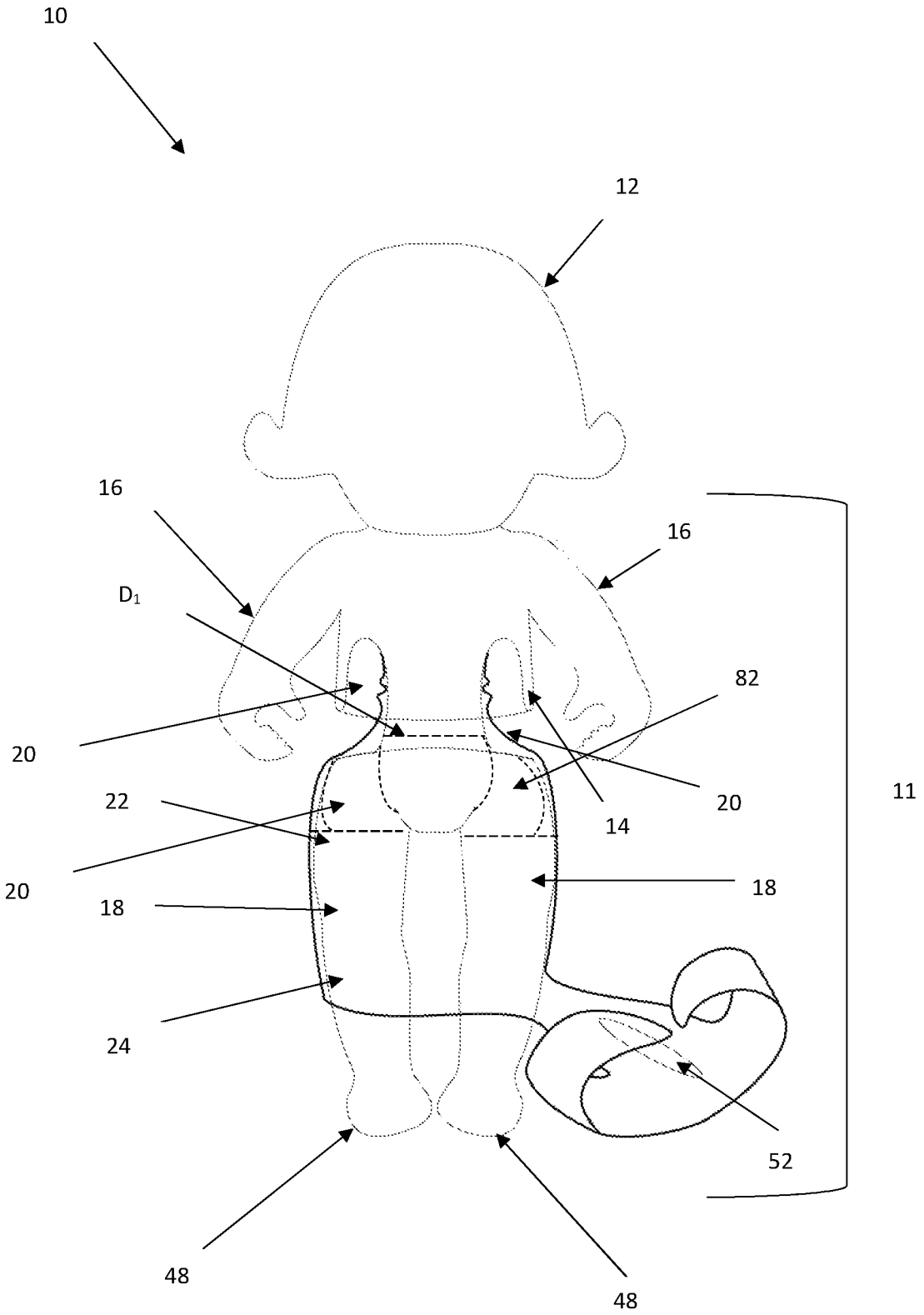
FIG. 36 is a cross-sectional view of the doll of FIG. 31 with the costume element being deployed into the cavity.
Figure 37:
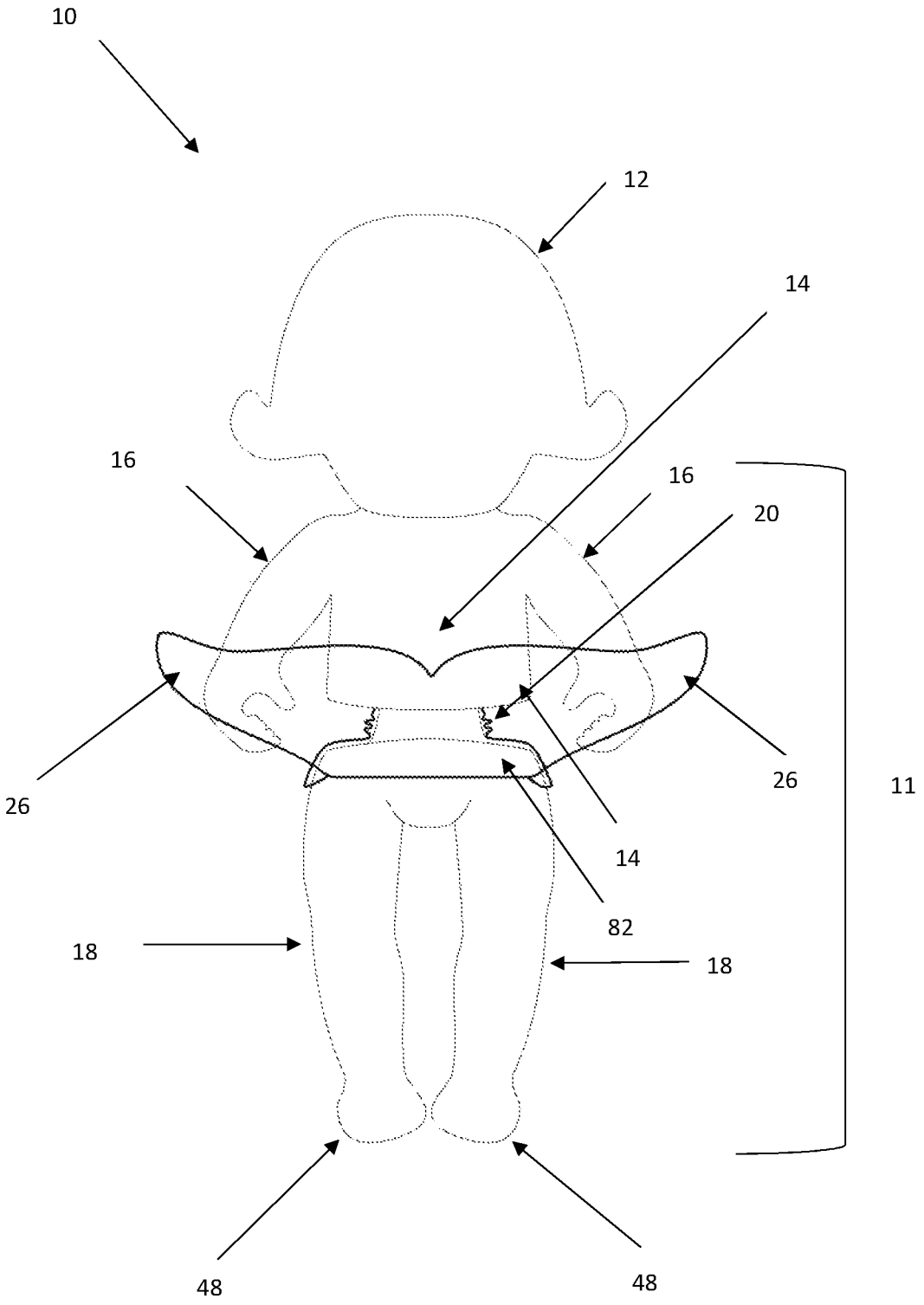
FIG. 37 is a cross-sectional view of the doll of FIG. 31 with the costume element being deployed into the cavity.
Figure 38:
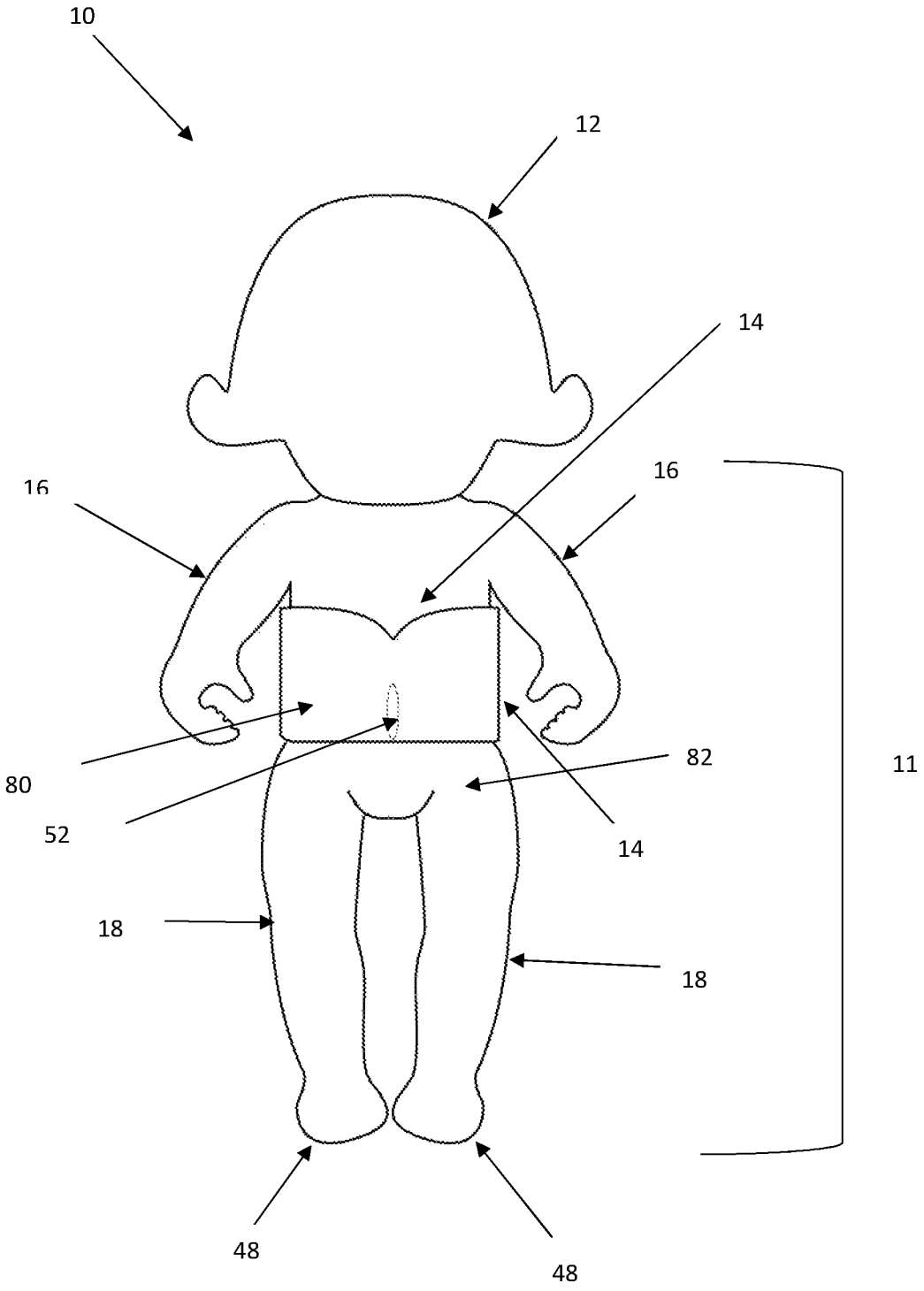
FIG. 38 is a front view of the doll of FIG. 31 with at least a portion the costume element disposed within the cavity and at least a portion of the costume element disposed outside of the cavity.

Now referring to FIG. 36-38, the costume element 22 may be removed from a portion of the body 11 of the doll 10. For example, the costume element 22 may be removed from the feet 48 of the doll 10 through the opening 52 and the hollow tube portion of the tail 24 may be moved from the feet 48 toward the waist 82 to place at least a portion of the costume element 22 inside the cavity 20. At least a portion of the costume element 22 may be secured and concealed within the cavity 20 and at least a portion of the costume element may be disposed around at least a portion of the doll 10.

Figure 39:
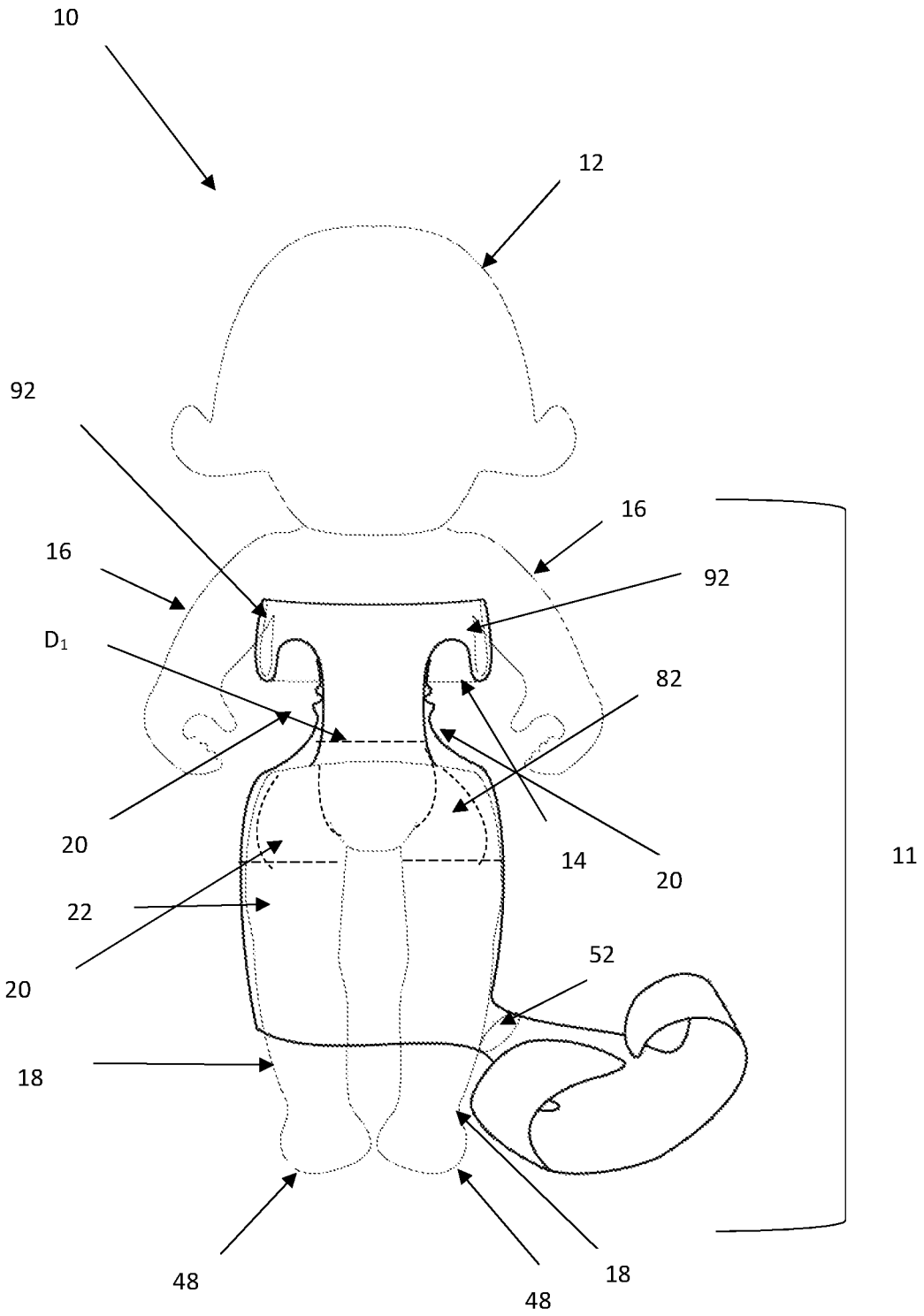
FIG. 39 is an exemplary embodiment of a cross-sectional view of the doll with the costume element being deployable from within the cavity.
Figure 40:
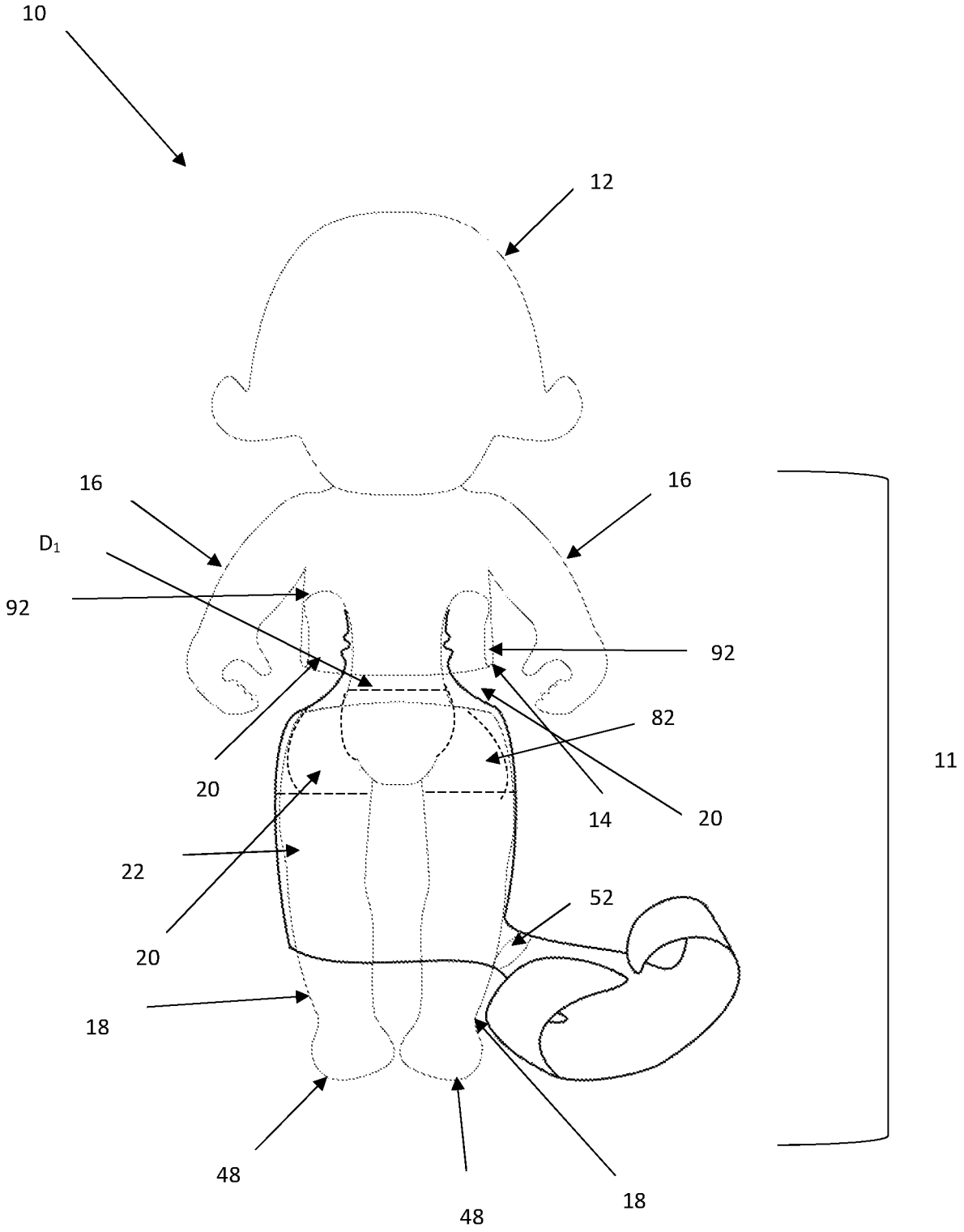
FIG. 40 is a cross-sectional view of the doll of FIG. 39 with the costume element being deployable from within the cavity.
Figure 41:
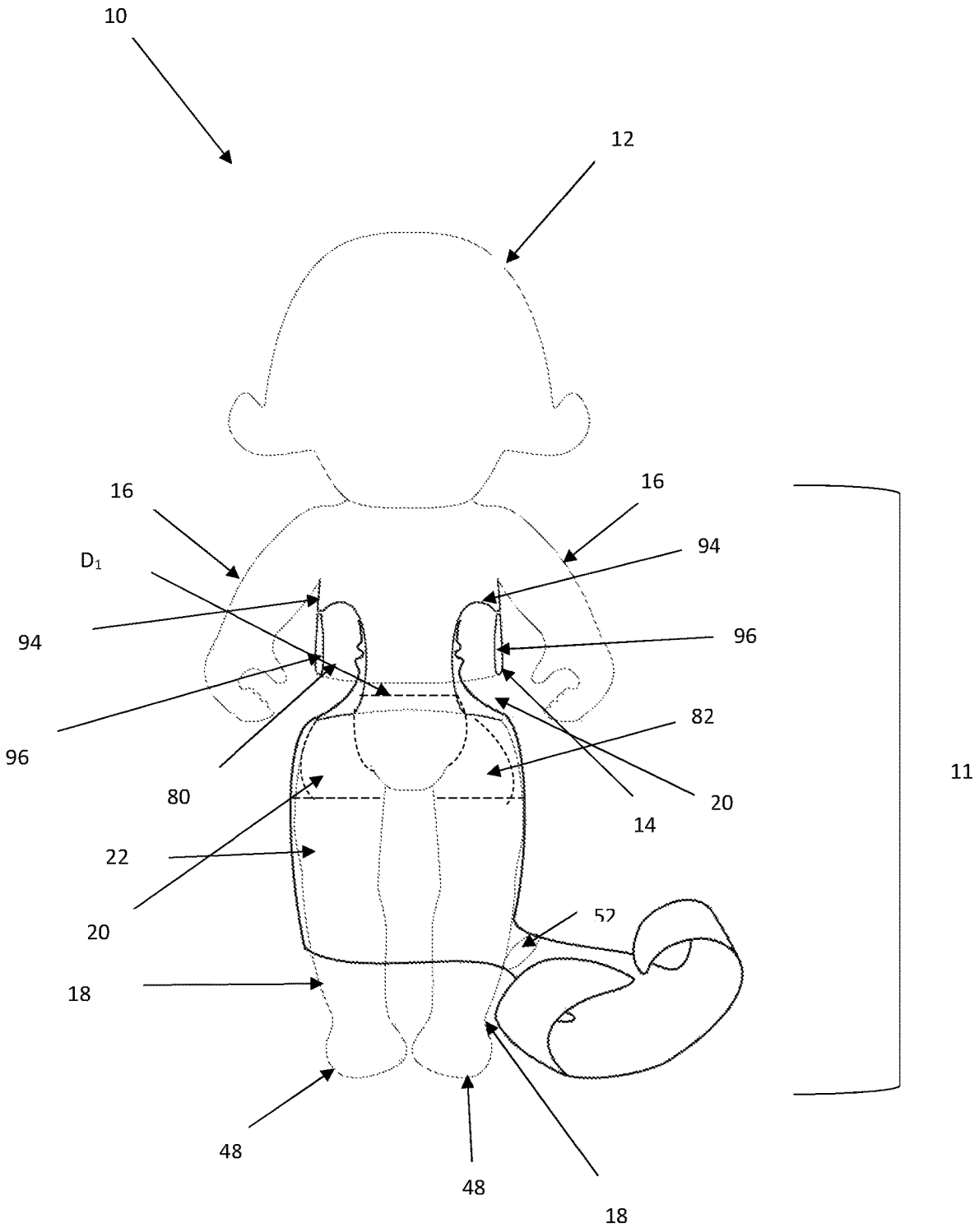
FIG. 41 is a cross-sectional view of the doll of FIG. 39 with the costume element being deployable from within the cavity.

In FIGS. 39-41, the doll 10 may also include at least one deformable element 92 and the deformable element 92 may be disposed on any portion of the body 11 depending upon where the costume element 22 is being deployed from. The deformable element 92 may have a first portion 94 and a second portion 96 opposite the first portion 94 or the deformable element 92 may be one unitary piece. For example, the deformable element 92 may be a portion of the first section 84 and/or the second section 86 and make the portion of the first section 84 and/or the second section 86 moveable into a variety of different positions. For example, at least a portion of the first section 84 and the second section 86 may be deformable and pliable and allow displacement so that there is access to the cavity 20 within the first section 84 and the second section 86. The deformable element 92 may be a flap or other type of covering that may be flexible and used to conceal a portion of the body 11. The deformable element 92 may be made from a flexible material including silicon rubber, neoprene rubber, natural rubber, synthetic-rubber, flexible elastomers including thermoplastic polyurethane ("TPU"), thermoplastic polyether ester elastomer ("TPEE"), and polyvinyl chloride (PVC). If the deformable element 92 has a first portion 94 and a second portion 96, the first portion 94 may have a first thickness and the second portion 96 may have a second thickness. The first thickness may be thicker than, the same as, or thinner than the second thickness depending upon how the deformable element 92 is going to be deformed. If the deformable element 92 is a unitary piece, the unitary piece may have the same thickness or varying thicknesses depending upon the direction and location of the movement. The differing thicknesses may allow the deformable element 92 to be rolled, folded, or bent into different positions. As a non-limiting example, the deformable element 92 may be a flap that is secured to a portion of the torso 14 and is movable into different positions to allow access to the cavity 20. In one position, the deformable element 92 may cover the cavity 20 in the torso 14. The deformable element 92 may be flexible, and it may be flipped to the upper portion of the torso 14 such that the cavity 20 may be exposed and may also be moved to conceal the cavity 20. If the deformable element 92 is made from more than one portion, for example, the first portion 94 may be more flexible than the second portion 96 so that the first portion 94 may be more easily rolled or folded to allow access to the cavity 20. Alternatively, the first section 84 and/or the second section 86 may be made out of a rigid material so that the costume element 22 may be placed into the cavity 20 inside the first section 84 and the second section 86 while both the first section 84 and/or the second section 86 maintain the same form without being deformed.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A doll, comprising:

a body defining a major longitudinal axis, the body having:

a torso having an interior portion and an exterior portion opposite the interior portion, the interior portion defining a first end along the major longitudinal axis;

a waist having an interior portion and an exterior portion, the interior portion of the waist defining a second end opposite the first end, the torso and the waist defining a cavity therebetween; and at least one appendage;

a connecting section disposed within the cavity along the major longitudinal axis, the connecting section being connected to the interior portion of the torso at the first end and the interior portion of the waist at the second end, the connecting section defining a first diameter and the interior portion of the torso defining a second diameter, the first diameter being smaller than the second diameter;

the torso and the waist each being movable along the connecting section to transition between a first position and a second position, the cavity being accessible in the first position and concealed in the second position; and at least one costume element being secured to the connecting section within the cavity and further being at least partially deployable from the cavity.

2. The doll of claim 1, wherein at least a portion of the torso is deformable.

3. The doll of claim 2, wherein the torso further includes a first portion with a first thickness and a second portion opposite the first portion with a second thickness, the first thickness being thinner than the second thickness.

4. The doll of claim 1, wherein the at least one costume element includes a tail and a fluke.

5. The doll of claim 4, wherein the tail has a first side and a second side opposite the first side, at least one opening being disposed on the second side of the tail.

6. The doll of claim 5, wherein the fluke is sized to be secured around at least a portion of the body.

7. The doll of claim 4, wherein the fluke includes a strip that is configured to be retained within the at least one costume element and sized to be received within the cavity.

8. The doll of claim 1, wherein the at least one appendage includes a plurality of appendages and the at least one costume element includes an opening sized to receive the plurality of appendages.

9. A doll, comprising:

a body defining a major longitudinal axis, the body having:

a torso with an interior portion and an exterior portion opposite the interior portion, the interior portion defining a first end along the major longitudinal axis;

a waist having an interior portion and an exterior portion, the interior portion of the waist defining a second end opposite the first end of the torso, the torso and the waist defining a cavity therebetween; and at least one appendage;

a connecting section disposed within the cavity along the major longitudinal axis, the connecting section being connected to the interior portion of the torso at the first end and the interior portion of the waist at the second end, the connecting section defining a first diameter and the interior portion of the torso defining a second diameter, the first diameter being smaller than the second diameter;

the torso and the waist each being movable along the connecting section to transition between a first position and a second position, the cavity being accessible in the first position and concealed in the second position; and at least one costume element being secured to the connecting section and further being at least partially deployable from the cavity.

10. The doll of claim 9, wherein the at least one costume element is a tail and a fluke.

11. The doll of claim 10, wherein the tail is sized to be received within the cavity.

12. The doll of claim 11, wherein the tail is disposed within the cavity.

13. The doll of claim 11, wherein the fluke includes a strip that is configured to be retained within the at least one costume element.

14. The doll of claim 13, wherein the tail has a first side and a second side opposite the first side, at least one opening being disposed on the second side of the tail.

15. The doll of claim 14, wherein the at least one costume element has a second opening, the second opening being sized to receive the at least one appendage.

16. The doll of claim 15, wherein at least a portion of the torso is deformable.

17. The doll of claim 11, wherein the fluke is sized to at least partially circumscribe the torso.

* * * * *